US009647328B2

(12) United States Patent
Dobric

(10) Patent No.: US 9,647,328 B2
(45) Date of Patent: May 9, 2017

(54) PATCH RADIATOR

(71) Applicant: KATHREIN-WERKE KG, Rosenheim (DE)

(72) Inventor: Nikola D. Dobric, Munich (DE)

(73) Assignee: KATHREIN-WERKE KG, Rosenheim (DE)

( * ) Notice: Subject to any disclaimer, the term of this patent is extended or adjusted under 35 U.S.C. 154(b) by 222 days.

(21) Appl. No.: 14/356,337

(22) PCT Filed: Oct. 4, 2012

(86) PCT No.: PCT/EP2012/004161
§ 371 (c)(1),
(2) Date: May 5, 2014

(87) PCT Pub. No.: WO2013/064204
PCT Pub. Date: May 10, 2013

(65) Prior Publication Data

US 2014/0285382 A1 Sep. 25, 2014

(30) Foreign Application Priority Data

Nov. 4, 2011 (DE) ..... 10 2011 117 690
Aug. 22, 2012 (DE) ..... 10 2012 016 627

(51) Int. Cl.
*H01Q 9/04* (2006.01)
*H01Q 1/38* (2006.01)

(52) U.S. Cl.
CPC ..... *H01Q 1/38* (2013.01); *H01Q 9/0414* (2013.01); *H01Q 9/0428* (2013.01); *H01Q 9/0442* (2013.01); *H01Q 9/0464* (2013.01)

(58) Field of Classification Search
CPC .. H01Q 9/0407; H01Q 9/0414; H01Q 9/0428; H01Q 9/0435; H01Q 9/0442;
(Continued)

(56) References Cited

U.S. PATENT DOCUMENTS 4,987,421 A * 1/1991 Sunahara ..... G06K 19/07786 343/700 MS
5,200,756 A 4/1993 Feller
(Continued)

FOREIGN PATENT DOCUMENTS

CN 101038984 A 9/2007
CN 101807739 A 8/2010
(Continued)

OTHER PUBLICATIONS

English translation of the International Preliminary Report on Patentability mailed Jun. 12, 2014, issued in corresponding International Application No. PCT/EP2012/004161.
(Continued)

*Primary Examiner* — Sue A Purvis
*Assistant Examiner* — Patrick Holecek
(74) *Attorney, Agent, or Firm* — Nixon & Vanderhye P.C.

(57) ABSTRACT

A patch radiator has a radiator surface designed as an annular and/or frame-shaped radiator surface, extending around a recess area. The radiator surface is extended so as to transition into the lateral surfaces or lateral walls. On the lateral surfaces or lateral walls, a lateral surface radiator structure electrically connected to the radiator surface is formed. In the peripheral direction of the lateral surfaces or lateral walls, there are lateral radiator surface sections, between which electrically non-conductive recess areas are provided.

35 Claims, 19 Drawing Sheets

(58) Field of Classification Search
CPC .... H01Q 9/045; H01Q 9/0464; H01Q 9/0471; H01Q 13/10; H01Q 13/103; H01Q 13/106; H01Q 1/38
USPC ..... 343/700 MS
See application file for complete search history.

(56) References Cited

U.S. PATENT DOCUMENTS

| | | | | |
|---|---|---|---|---|
| 5,400,039 | A * | 3/1995 | Araki | H01Q 1/32 343/700 MS |
| 6,891,508 | B2 * | 5/2005 | Inoue | H01Q 1/38 343/725 |
| 7,064,714 | B2 * | 6/2006 | Lafleur | H01Q 1/243 343/700 MS |
| 8,077,092 | B2 * | 12/2011 | Coupez | H01Q 1/38 343/700 MS |
| 8,446,322 | B2 * | 5/2013 | Tatarnikov | H01Q 9/0414 343/700 MS |
| 2009/0140930 | A1 | 6/2009 | Tatarnikov et al. | |
| 2010/0033382 | A1 | 2/2010 | Chou | |
| 2010/0201580 | A1 * | 8/2010 | Goldberger | H01Q 9/0407 343/700 MS |
| 2011/0012788 | A1 | 1/2011 | Rowell et al. | |
| 2011/0032154 | A1 | 2/2011 | Chung et al. | |
| 2011/0148715 | A1 | 6/2011 | Yang | |

FOREIGN PATENT DOCUMENTS

| | | | |
|---|---|---|---|
| DE | 10 2004 016 158 | | 11/2005 |
| EP | 1 536 511 | | 6/2005 |
| EP | 1 376758 | | 9/2005 |
| EP | 1 684 381 | | 7/2008 |
| EP | 1 706 916 | | 3/2011 |
| FR | 2 869 726 | | 11/2005 |
| GB | 2 429 336 | | 2/2007 |
| JP | 4-337908 | A | 11/1992 |
| JP | 2002-152069 | A | 5/2002 |
| JP | 2004-128601 | A | 4/2004 |
| JP | 2007-129417 | | 5/2007 |
| JP | 2011-505748 | A | 2/2011 |
| WO | WO 02/063714 | | 8/2002 |
| WO | WO 2006/036116 | | 4/2006 |
| WO | 2009/073105 | A2 | 6/2009 |
| WO | WO 2010/035104 | | 4/2010 |
| WO | WO 2010/092582 | | 8/2010 |

OTHER PUBLICATIONS

International Search Report for PCT/EP2012/004161, mailed Feb. 4, 2013.
Foreign-language Written Opinion of the International Searching Authority for PCT/EP2012/004161, mailed Feb. 4, 2013.
Ryu, M-R et al., "Baseball-shaped Circular Microstrip Antennas for Miniaturization", Advanced Communication Technology, vol. 3, No., pp. 1657-1660, (Feb. 20-22, 2006).
Ryu, M-R et al., "Skimmer-shaped linear polarized circular microstrip antennas for miniaturization", Advanced Communiction Technology, vol. 1, pp. 755-758, (Feb. 20-22, 2006).
Kim, W-K et al., "Miniaturization of 3-D Microstrip Antenna using Fylfot-Shaped Structure", Applied Electromagnetics and Communications, pp. 1-4, (Oct. 12-14, 2005).
Lee, H.R. et al., "A Miniaturized, Dual-Band, Circularly Polarized Microstrip Antenna for Installation into Satellite Mobile Phone", Antennas and Wireless Propagation Letters, IEEE, vol. 8, pp. 823-825, (2009).
Jang, Y-J et al., "The Miniaturized Microstrip Antenna with 'L' Type Plates", Applied Electromagnetics and Communications,pp. 1-4, (Oct. 12-14, 2005).
Seo, J-S et al., "Miniaturisation of Microstrip Antenna Using Irises", Electronics Letters, vol. 40, No. 12, pp. 718-719, (Jun. 10, 2004.
Chinese Search Report dated Apr. 14, 2015, issued in corresponding Chinese Application No. 201280053968.X.

* cited by examiner

PATCH RADIATOR

This application is the U.S. national phase of International Application No. PCT/EP2012/004161, filed 4 Oct. 2012, which designated the U.S. and claims priority to DE Application No. 10 2011 117 690.3, filed 4 Nov. 2011; and DE Application No. 10 2012 016 627.3, filed 22 Aug. 2012, the entire contents of each of which are hereby incorporated by reference.

The invention relates to a patch radiator according to the preamble of claim 1 according to the main patent DE 10 2011 117 690.3.

Patch radiators in principle are sufficiently known, for example from DE 10 2004 016 158 A1.

Such patch radiators are known to comprise a dielectric substrate with an upper side, an underside and circumferential wall portions, i.e. lateral surfaces. In this respect it is a three-dimensional object, which in most applications is square-shaped in plan view. In this case a closed, likewise square radiator surface is constructed on the upper side and is supplied by a feeder line perpendicular thereto that runs through the whole substrate and is supplied from underneath.

On the underneath, a ground plane is provided, which optionally extends beyond the outer contour of the substrate, the ground plane being provided with a corresponding hole-shaped recess through which the feeder line referred to runs as far as the underside of the ground plane, by means of which the radiator surface is supplied.

Patch radiators are often used as circular polarised radiators and antenna devices.

In order to be able to receive circular electromagnetic waves (or to be able to transmit them also), in particular when the patch antenna is to be used to receive satellite signals, for example (e.g. as a GPS antenna, etc.), the radiator surface, which is normally square in plan view, is provided with discontinuities worked into the corner regions, so-called bevels. They constitute triangular flat portions or recesses, for example, worked into two opposite corners thus forming the circularity of the patch antenna.

Finally, it is also known how to achieve circularity, for example, by means of two feed points offset by 90° provided outside the central axis of the patch antenna and at which two feeder lines located offset to each other end. This is because it can be ensured by means of an appropriate phase shifting in the supply that circular polarised electromagnetic waves (normally transmitted by satellite, as already mentioned) can be received.

Such circular polarised patch antenna are often used—as already mentioned—as GPS antennae, especially in motor vehicle antennae, as well as a number of other antenna devices, such as for performance of mobile radio services, reception of radio programmes, etc.

In principle, there is interest in GPS antennae, which take up as little installation space as possible. A reduction in size of conventional patch antennae can, however, only be achieved by appropriately selecting a particularly suitable substrate. Normally ceramic is used as the substrate, which should have as large an $\epsilon_r$ value as possible.

A generic patch radiator has become known, for example, from US 2011/0 148 715 A1. It comprises a square substrate (dielectric) on the upper side of which an electrically conductive radiator surface is constructed. The radiator surface is provided with an annular recess in the centre. The radiator surface is supplied via a feeder line extending past it on an outer edge of the radiator surface on the dielectric.

Prior art that is comparable in this respect is also to be taken as known from an embodiment of FIG. 5 in FR 2 869 726 A1.

Patch radiators, which have various geometries, are also to be taken as known from WO 2006/036 116 A1. These are predominantly square or almost square radiator surfaces, which are provided with a wide range of different forms of recesses inside, for example in an H form, in the form of a double trapezium, etc. They are supplied via a feeder line, which is offset from the outer circumferential edge of the radiator surface and likewise from the inner border edge of the recess worked into the radiator surface.

In addition patch radiators and patch radiator arrangements have also become known, which have a totally different construction.

For example, US 2011/0 012 788 A1 describes a circular polarised patch radiator arrangement, which does not have an annular and/or frame-shaped radiator surface, but rather a radiator surface with a square basic structure, which is provided with a large number of slits. A slit runs from each exterior corner of the radiator surface towards the centre. In addition, slit-shaped recesses, which lead to larger recesses offset in relation to them, are worked into the long sides. Ultimately, this is a folded patch antenna with slits, which serves to reduce the size of the antenna. Circularity is achieved in the same way as with a patch antenna by means of the discontinuities on the exterior contour referred to. As a result of the slits referred to, the patch antenna is, however, very narrow band altogether.

In contrast, WO 02/063 714 A1 shows so-called fractal antennae. These fractal antenna structures can have an enclosed radiator surface. It is also shown that the fractal structure can be constructed not only on the exterior circumference of the patch antenna, but rather also in a central recess area.

In contrast, the object of the present invention is to create a patch antenna and in particular a circular polarised patch antenna, which should have as small an antenna volume as possible in relation to its bandwidth.

The object is achieved according to the invention in accordance with the features described in claim 1. Advantageous embodiments of the invention are described in the sub-claims.

It must be described as quite surprising that it has become possible in the context of the present invention for the required antenna volume of the patch antenna according to the invention to be reduced by up to 50% (or even more) in comparison to conventional standard patch solutions. Vice versa if the size of the patch antenna remains the same (in comparison to a conventional standard patch antenna) the bandwidth of the antenna can be increased by about 50% and thus improved significantly.

This becomes possible in the context of the invention, in that the outer lateral or wall surfaces of the supporting body, i.e. the substrate, have likewise been used for the design of the antenna, among other things. In other words, the radiator structure on the upper surface of the substrate in the form of an annular or frame-shaped radiator is extended to the lateral or outer surfaces of the three-dimensional substrate, meaning that the volume of the supporting body can be used to the optimum. As a result, a very compact design of the antenna can be achieved. In the process, on the interior of the annular or frame-shaped radiator structure on the upper side of the substrate, a specific supply structure is also provided with which the antenna can be operated as a circular polarised antenna.

According to the invention, it is provided that the radiator surface located on the upper side of the substrate is constructed in an annular or frame shape in principle and specifically forming a recess area surrounded by this annular or frame-shaped radiator surface structure. The term "annular radiator structure" is understood to mean any circumferential or frame-shaped radiator structure, i.e. also structures, which do not have to be circular in plan view, but can for example also form a square or regular n-polygonal frame, etc.

On the inside of this annular and/or frame-shaped electrically conductive radiator surface, a specific supply structure is provided, which has at least two feed points, which are electrically connected to the annular and/or frame shaped radiator structure eccentrically at the transfer or connection points and specifically forming two phase shifter lines.

As a result of the preferably eccentric arrangement, the principle of a "phase shifter" is emulated, by means of which a different run time is generated from the feed point to the respective portions (connection points) on the annular and/or frame-shaped strip conductor structure, the circularity of the patch antenna thus being created.

The extension of the radiator design from the upper side of the substrate to the lateral walls, i.e. the lateral surfaces of the substrate, which is provided in addition, can be achieved and constructed in different ways.

In a preferred embodiment, the radiator structure provided on the lateral or wall surfaces of the substrate comprises a large number of radiator portions extending from above to below, which are offset against each other in the circumferential direction of the lateral or wall surfaces. These radiator portions constructed or extending from above to below on the lateral walls are connected electrically and galvanically to the radiator surface located on the upper surface of the substrate. Generally speaking, therefore, the radiator surface located on the upper side of the substrate transitions into radiator portions, which are, for example, finger-shaped, extending downwards towards the ground plane at the surrounding lateral walls of the substrate, said portions being arranged at a distance from one another in the circumferential direction of the substrate through portions located in between them that are not electrically or galvanically conductive. These radiator portions, which are, for example, finger-shaped, connected to the radiator surface located on the upper side of the substrate and extending downwards, preferably extend to a partial height of the substrate and therefore to a partial height of the lateral walls.

The lateral radiator surface portions referred to, which transition into the radiator surface located on the upper surface of the patch antenna, can have a wide range of different forms per se.

It is possible for the electrically conductive portions extending from above to below to be constructed as strips when observed from the side and for example to be separated from each other using strip-shaped electrically non-conductive portions. This results in a meandering or similarly shaped rectangular structure.

A wave-shaped surrounding structure is also possible, as a result of which downward protruding, mound-shaped elevations or projections are formed with valleys projecting upwards in between.

These structures can, however, also be triangular, trapezoid, etc. for example, when regarded from the side. There are no limitations in this respect.

A major reason for the compact design of the antenna according to the invention is, however, the use of the exterior surfaces of the supporting body, i.e. the dielectric or substrate. This is because the radiator surface of the patch antenna is extended, effectively starting from the upper side of the substrate towards the surrounding lateral surfaces and thus enlarged. This extension can be achieved and constructed in a wide variety of ways and manners.

In the context of the invention, the bandwidth of the patch antenna according to the invention is also significantly improved in comparison to conventional solutions in the process, i.e. by forming a large number of additional lateral radiator surface portions, by means of which a limiting line for the electrically conductive radiator structure is formed, the circumferential length of which is significantly larger than the actual circumferential length of the structure of the substrate. In addition, the vertically polarised proportion of the electromagnetic field (terrestrial gain) is also strengthened as a result, since the lateral radiation surface portions (also referred to hereinafter sometimes as finger-shaped portions) connected to the radiator surface and extending downwards on the lateral walls are or can be constructed similar to ridges, the protruding portions then functioning as small vertical radiator elements.

As a result of these steps, a significantly smaller patch antenna in terms of volume (compared to conventional solutions) and/or a patch antenna with significantly improved bandwidth can be formed. For example, within the scope of the invention the patch antenna can also be reduced in size compared to conventional patch antenna, and this can be achieved at the same time as improved bandwidth.

In a preferred embodiment of the invention, the lateral surface radiator structure starting from the radiator surface (provided on the upper surface of the substrate) is constructed in the form of a metallisation, which is constructed or provided directly on the lateral surfaces or lateral walls of the substrate. Alternatively, however, it is also possible for these lateral surface radiator structures to be provided and positioned at a distance from the lateral surfaces or lateral walls of the substrate, for example by using a separate supporting structure for this lateral surface radiator structure or preferably a lateral surface radiator structure in the form of a metal plate or similar. In the process, the whole radiator is preferably formed out of such a metal plate and can, for example, be positioned on the upper side of the substrate or, for example, be bonded to it or pressed onto it. This lateral surface radiator structure can then project beyond the edge or beyond the lateral walls or lateral surfaces at intervals and even protrude at an angle, in contrast to the lateral surface portions that may extend at right angles, angled at the lower end with respect to the radiator surface, etc. Many different modifications are possible here. For example, also with multiple folded, bent or edged lateral surface radiator portions protruding outwards at various distances. In this case, even the feeder line can be stamped out of the metal plate at the same time and angled downwards towards the radiator surface at right angles extending through the substrate, it being possible to achieve production advantages as a result.

Within the scope of the invention an improved supply is also achieved.

In the process, within the scope of the invention supply structures constructed in a wide variety of ways and provided with a wide range of geometries can be used, which are based on the principle of galvanic or alternatively also on the principle of a capacitive supply.

In the process, it is likewise possible to supply the patch antenna only via a feeder line or for example via two feeder lines offset by 180°.

In summary therefore, the antenna according to the invention and provided with an annular or frame-shaped structure is characterised by the following advantages:

The dimensions of the supporting body, i.e. the substrate, can be reduced by using the antenna according to the invention (miniaturisation of the antennae).

By means of the described annular and/or frame-shaped structure there is also the possibility of switching to other substrate materials, which have a lower dielectric constant. Plastics can thus be used, for example. Plastic materials are normally cheaper than ceramic materials. This leads to a desirable cost reduction and cost saving.

Moreover, the use of plastics provides an additional advantage inasmuch as they have good electrical properties with a lower loss factor. Moreover, plastics with these properties can be used. The performance, bandwidth and gain of the antenna according to the invention can thus be improved, a significant increase in performance being achievable.

Finally, the antenna according to the invention is easy to handle altogether despite the reduced size. The frequency can easily be adjusted as a result of the arrangement of the outer surfaces in that the outer surfaces are shortened, for example, or inserted into slits extending from the outside into the radiator surface. This leads overall to easy handling.

In another configuration of the invention it is possible moreover to design the substrate so it is at least partially box-shaped, i.e. by forming an interior accessible from below. In the process, this interior can be dimensioned in size such that a circuit board with appropriate electrical or electronic components can, for example, be provided there and specifically at a chosen height of the space created there.

In a particularly preferred embodiment, a very compact patch antenna arrangement can be created by providing another patch antenna, preferably close to the ground plane, inside the patch arrangement that has been described, i.e. overlapping or encompassed by it. This additional patch antenna can be constructed as a simple polarised patch antenna, a continuous metallised patch surface or, for example, as a dual or circular polarised patch antenna.

Especially when the inner or lower additional patch antenna is constructed as a GPS receive antenna, i.e. with a normally continuous radiator surface, which is arranged on a dielectric consisting of ceramic, the first annular or frame-shaped patch antenna located above it is constructed such that it serves to receive the SDARS signals, for example.

Likewise preferable, however, is a variant in which the interior patch antenna is also constructed with an annular or frame shape and is supplied in the process via interior phase shifter lines in order to create a circular polarised patch antenna, which is constructed in an annular or frame shape like the elucidated patch antenna according to the invention, i.e. it has an annular or frame-shaped radiator surface, in the recess area of which the phase shifter lines leading to two different feed points are provided, via which this second patch antenna can then be supplied via a separate feeder line and the two branch phase shifter lines.

In other words therefore within the scope of the proposed invention, two annular patch antennae are nested one in the other, it being possible as a result to cover two services with a relatively small size. In the process, the lower or inner annular or frame-shaped radiator surface of the inner patch antenna serves, for example, to receive SDARS signals, whereas the outer or upper patch antenna with an outer or higher radiator surface serves, for example, to receive GPS signals. An additional minimisation of the antenna structure is achieved as a result of the mutual coupling of the antennae. In the process, the antenna support can preferably be plastic and the radiator surfaces of the antenna structures referred to can be stamped and/or folded plates, for example. Alternatively, the antenna structure can, for example, be produced with the aid of 3D-MID technology, i.e. from three-dimensional electrical assemblies (moulded interconnect devices—MID).

This second patch antenna can in turn likewise preferably be provided with electrically conductive extensions extending transverse to the radiator surface on its outer circumference, for example in the area of the lateral walls of a supporting structure for this radiator surface.

In the case of this variant, the antenna can, for example, be inserted such that the outer annular or frame-shaped patch antenna can, for example, be used as an antenna for receiving signals transmitted by Global Navigation Satellite System (GNSS), for example GPS signals, whereas the lower and/or inner annular or frame-shaped antenna can be used, for example, for receiving SDARS signals.

In a particularly preferred embodiment therefore, the two patch radiators arranged one on top of the other can be formed the same or similarly in terms of their structure, the for example zigzag or meandering extensions provided on the surrounding sides of the second patch radiator surface and extending transverse to the radiator surface normally being dimensioned so as to be smaller in height than the corresponding extensions on the upper patch radiator.

The invention is explained in more detail hereinafter with reference to the embodiments and drawings, in which FIG. 1: shows a schematic three-dimensional view of a patch antenna according to the invention;

FIG. 2: shows a vertical cross-section parallel to a lateral wall of the patch antenna shown in FIG. 1;

FIG. 2*a*: shows a drawing corresponding to FIG. 2 in which it is shown more clearly that the ground plane is formed on the upper surface of a circuit board and the feeder line for the patch antenna can be fed through a recess in the ground plane and a drilled hole in the circuit board as far as the underside of the circuit board, where it is electrically connected.

FIGS. 3*a* to 3*d*: show four schematic side views of the lateral walls of the substrate with the different radiator structure formed on top of it;

FIG. 4: shows a schematic view of an equivalent circuit diagram of the patch antenna according to the invention:

FIGS. 5*a* to 5*j*: show eight different views of a possible supply structure for the circular polarised patch antenna according to the invention;

FIG. 6: shows a modified embodiment of a patch antenna with a cylindrical substrate and an annular radiator surface located on top of it;

FIG. 7: shows an embodiment modified from FIG. 1 with a modified, doubled supply structure;

FIG. 8: shows an equivalent circuit diagram for the embodiment according to FIG. 7;

FIG. 9: shows a cross-sectional view through a patch antenna modified from FIG. 2 with lateral surfaces extending on the central axis 7 facing the direction of radiation;

FIG. 10: shows an embodiment modified from FIG. 9, in which the lateral surfaces of the substrate extend in the direction of radiation pointing away from the central axis 7;

FIG. 11: shows an embodiment modified from FIGS. 1 and 2 in a vertical cross-sectional view comparable to FIG. 2, in which the lateral surface radiator structure is provided at a distance from the surface of the lateral wall of the substrate;

FIG. 12: shows another embodiment modified from FIG. 11 in a vertical cross-section;

FIG. 13: shows another modification of FIGS. 11 and 12 in a simplified vertical cross-section;

FIG. 14: shows a spatial view of an embodiment with a radiator structure consisting of a metal plate;

FIG. 15: shows a cross-sectional view through the embodiment according to FIG. 14;

FIG. 16: shows a spatial cross-sectional view of another modified embodiment with a box-shaped surrounding hollow space within the substrate;

FIG. 17: shows a cross-sectional view with a circuit board accommodated integrally in the hollow space at a central height;

FIG. 18: shows a modification of FIG. 17, in which a circuit board with electronic assemblies is arranged on the underside of the supporting wall of the substrate that is uppermost;

FIG. 19: shows a perspective view of another embodiment of a patch antenna arrangement with two patch antennae stacked one in or on the other;

FIG. 20: shows a corresponding view of the embodiment according to FIG. 19 in an exploded view;

FIG. 21: shows a plan view onto the embodiment according to FIG. 19;

FIG. 22: shows a vertical sectional view perpendicular to the radiator surfaces along the line A-A in FIG. 21;

FIG. 23: shows a vertical sectional view perpendicular to the radiator surfaces along the line B-B in FIG. 21;

FIG. 24: shows a perspective view from underneath of the embodiment according to FIGS. 19 to 23;

FIG. 25: shows a resonance diagram of the patch antenna arrangement;

FIG. 26: shows an embodiment modified from FIG. 20 with a continuous second patch antenna in a spatial view;

FIG. 27: shows a cross-sectional view through the embodiment according to FIG. 26;

FIG. 28: shows an embodiment modified again with a three-dimensional outer patch antenna and a two-dimensional patch antenna located below it in a three-dimensional view;

and

FIG. 29: shows the patch antenna arrangement shown in FIG. 28 in an exploded view.

In FIG. 1, a patch antenna 1 is shown in terms of its basic layout and specifically in a schematic three-dimensional view.

This is preferably a circular polarised patch antenna.

The patch antenna comprises—as can be seen in the cross-sectional view according to FIG. 2—a dielectric body 3, which is sometimes referred to hereinafter as a substrate.

This three-dimensional substrate comprises an upper side 3*a*, an underside 3*b* and circumferential lateral walls 3*c*, which are sometimes also referred to hereinafter as lateral surfaces 3*c*.

In the shown embodiment, the lateral walls or lateral surfaces 3*c* extend vertically to the upper surface or underside 3*a*, 3*b* of the substrate and thus parallel to the central axis 7, which cuts through the upper surface and underside of the substrate vertically and centrally.

Instead of the terms "lateral walls" or "lateral walls" 3*c* the term lateral surface space S is sometimes used hereinafter since—as will emerge below—the additional structural design is no longer provided directly on the surface of the side walls 3*c*, but rather can be provided at a distance from them.

The substrate can consist of a suitable material. Preferably, ceramic with a comparatively low value for permittivity, i.e. the dielectric conductivity, is used. This also opens up the opportunity not just to be forced to use ceramic as the substrate, but also preferably plastic, for example, especially when the patch antenna is to be used for receiving programmes transmitted via SDARS (in particular in the North American region) or for receiving positional data transmitted via GPS. As a result the losses can be minimised. The values for $\epsilon_r$ can, for example, preferably range between 2 and 20.

In the embodiment shown, an electrically conductive radiator surface 11 is formed on the upper surface 3*a* of the substrate (or generally above the upper surface 3*a*), for example in the form of a metallisation provided on the upper surface 3*a*. If the metallisation should be arranged in the form of a metal plate this can be bonded or pressed onto the upper surface of the substrate, for example, a good adhesion being achievable as a result.

Moreover, the radiator surface 11 is not constructed as a closed radiator surface, but rather annular or frame-shaped, i.e. in the form of a circumferential (closed) radiator surface forming at least one recess 13, which is surrounded by the circumferential closed radiator surface 11 and inside which a supply structure 15, which will be explained in more detail below, is provided for the radiator surface 11.

In other words, the annular and/or frame-shaped radiator surface 11 is formed such that it is arranged around a central axis 7, which normally cuts through the patch antenna centrally and specifically in a plane that normally extends perpendicular to the central axis 7.

On the underside 3*b* of the substrate 3 or below this underside 3*b*, a ground plane 17 is formed—as is customary in patch antennae—which can likewise be provided in the form of a metallisation. In the embodiment shown, the ground plane 17 has larger dimensions in the longitudinal and transverse direction than in the longitudinal and transverse direction of the substrate, so that the ground plane 17 projects beyond the lateral walls 3*c* of the substrate.

In the process the ground plane can consist of a metal plate. It is also possible for the ground plane 17 to be constructed from a metallisation, which is preferably provided on the upper surface facing the patch antenna, the patch antenna 1 then being positioned, for example bonded, with the underneath of its substrate on this metallisation formed on the circuit board LP. The use of an appropriate circuit board can be seen by way of example in the cross-sectional view according to FIGS. 2 and 2*a*. In the process, the ground plane 17 can, however, also be a structural component, onto which the patch antenna described above is placed without a separate ground plane of its own, for example in that the patch antenna with its substrate is positioned, for example bonded, onto the body panel of a motor vehicle.

It can already be seen from the view according to FIG. 1 that the patch antenna 1 according to the invention is also provided with a lateral surface radiator structure 18 on its circumferential lateral walls or lateral surfaces 3*c*, which is electrically and galvanically connected to the radiator surface 11 on the upper side 3*a* of the substrate 3 and in the embodiment shown transitions into this radiator surface 11.

In the process, in the embodiment shown, the lateral surface radiator structure 18 consists of a large number of lateral radiator surface portions 19, which are electrically and galvanically connected to the radiator surface 11 with the ends 19*a* facing the radiator surface 11 and transition into the radiator surface 11. The opposite end 19*a* therefore extends away from the radiator surface 11 towards the ground plane 17 and ends freely at a distance from it, i.e. generally without galvanic contact with the ground plane 17.

Thus electrically non-conductive recess areas 20, which extend at least to a partial height of the respective lateral wall 3*c*, are formed between two adjacent lateral radiator surface portions 19.

As a result, an overall lateral surface or overall radiator structure 25 is ultimately created, which comprises both the radiator surface 11 located on the upper side 3*a* of the substrate 3 and the additional lateral surface radiator structure 18 located on the lateral walls or lateral surfaces 3*c* with more than one associated lateral radiator surface portions 19. Using these external lateral surfaces 3*c* of the substrate 3, the total surface of the radiator structure can therefore be increased without the dimensions of the patch antenna having to be increased. Simultaneously, however, not only the whole radiator surface is enlarged by this expansion onto the lateral walls, but especially the whole limitation or contour line 23, which surrounds the whole radiator surface and by means of which the limit line is defined that separates the lateral radiator surface portions 19 from the recess areas 20, is also increased.

With reference to the embodiment described thus far, it emerges that the lateral surface radiator structure 18 is provided directly on the surface of the surrounding lateral surfaces or lateral walls 3*c* of the substrate, which lends itself in particular if the relevant overall radiator structure is constructed in the form of a metallised surface on the corresponding surface areas as a result of which therefore the upper radiator surface 11 and the lateral radiator surface portion 19 provided in the surrounding region are formed. It should, however, already be noted at this point that especially the lateral radiator surface portion 19 can also be provided at a lateral distance to the respective surface of the lateral walls 3*a*, e.g. if, for example, a support structure is used that projects laterally beyond the lateral walls which, for example, is placed onto the substrate in the manner of a box that is open underneath so that comparatively thin flange portions are formed circumferentially, which are located at a distance from the lateral walls of the substrate 3*c* referred to so that the lateral surface radiator structure 18 referred to can be formed on these flange portions. Likewise, the whole radiator structure can, for example, preferably be produced, edged, bent, etc. from a metal plate so that the radiator surface 11 located on top of the substrate transitions into a lateral surface radiator structure 18, the lateral radiator surface portion 19 of which comes to rest at a distance from the lateral walls 3*c*. Accordingly, it is generally also said that the lateral radiator surface portions 19 are not only formed directly on the lateral surfaces or lateral walls 3*c* of the substrate but are provided in the lateral surface or lateral wall area S, which is located at a distance in front of the lateral surfaces or lateral walls 3*c*. Accordingly, as already mentioned, lateral surface space S is sometimes also referred to in which the lateral surface radiator structure 18 is provided and/or formed. This will be described more below with reference to additional embodiments.

In the embodiment shown according to FIG. 1, the lateral radiator surface portions 19 extend to a partial height 19' of the total height H of the substrate 3, therefore ending at a distance 27 from the underside 3*b* of the substrate.

Likewise, the recess areas 20 extend between two lateral radiator surface portions 19 at a partial height 20' of the substrate 3 and end at a distance 29 below the upper side 3*a* of the substrate 3.

In FIG. 2, a cross-sectional view is shown in which on the left-hand side of the patch antenna the section extends through a lateral radiator surface portion 19, which extends downwards, namely at a partial height 19' starting from the upper radiator surface 11, whereas on the right-hand side of the sectional view a section is shown, which extends through a recess area 20, which extends upwards to a partial height 20' from the ground plane 17 so that the recess area ends at a distance 29 in front of the upper side 3*a* of the substrate 3.

As a result of this arrangement, the lateral radiator surface portions 19 are effectively connected to each other at their ends facing the radiator surface 11 via an electrically conductive strip 29 on the lateral wall 3*c*. Similarly, the electrically non-conductive recess areas 20 are connected to each other via a strip 33 located below, in front of which the forwards protruding area of the lateral radiator surface portions 19 ends.

Accordingly, an overlapping area 35 emerges, with a partial height 35*a* in the embodiment shown, in which the electrically conductive lateral radiator surface portions 19 and the recess areas 20 are constructed so as to be adjacent to each other.

The height 20' of these recess areas 20 and the height 19' of the lateral radiator portions 19 and the height 35' of the overlapping area 35 can be selected so as to vary within wide ranges. They can extend along the total height of the lateral walls or only along a partial height. There are no limitations in this respect. Moreover, the heights and partial heights of the lateral radiator surface portions 19 and the recess areas 20 can be dimensioned differently at different points so that even the remaining portions 27, 29, 31, 33 at various points of the circumferential lateral wall 3*c* can have different values. The slit-shaped recesses 20 that have thus been formed can possibly even reach up to the upper side 3*a* of the substrate 3, just as the height or length of the lateral radiator surface portions 19 can reach at least up to almost the level of the ground plane 17.

The width of the large number of lateral radiator surface portions 19 and the width of the recess areas 20 can be selected as required within wide ranges. These widths can also vary in a single embodiment. The smaller the widths become, the larger and therefore longer the limitation/contour line 23 becomes.

For example, preferably 4 to 16 lateral radiator portions 19 and therefore also recess areas 20 can be arranged following on from each other, i.e. adjacent to each other, on the whole circumferential surface 3*c* or in the lateral surface space S. Preferred figures can range between 10 to 50 or 20 to 40. There are no real restrictions, a larger number leading to an enlargement of the limitation/contour line 23 as mentioned, which is advantageous. Accordingly, the above-mentioned values are only to be seen as examples, i.e. without restriction.

Likewise, different shapes of the lateral radiator surface portions 19 and the recess areas 20 can be selected.

It emerges from the description of the construction of the patch antenna according to the invention that the main reason for the compact design of the antenna is the use of the outer lateral surfaces or lateral walls 3*c* of the supporting body 3. This is because the radiator surface 11 located on the upper surface 3*a* of the substrate thus transitions into the lateral walls 3*c* as a result of which the whole radiator surface is enlarged.

Moreover, as a result of the patch antenna described, the vertically polarised portion of the electromagnetic field (terrestrial gain) is strengthened since a comb-like lateral surface radiator structure 18, in which the lateral radiator surface portions 19 function as small vertical radiator elements, is created by the lateral radiator surface portions 19, which are finger-shaped in the embodiment shown.

In addition, the lateral surface radiator structure 18 referred to in the embodiment shown in FIGS. 1, 2 and in the detailed view according to FIG. 3*a* is designed with rectangular lateral radiator surface portions 19 and rectangular recess areas in between, such that a meandering shaped structure, i.e. a meandering shaped limitation and/or contour line 23, emerges by means of which the rectangular lateral radiator surface portions 19 are separated from the recess areas 20, which are offset in the circumferential direction.

With reference to FIG. 3*b*, it is only shown schematically that the portions 19 and recess portions 20 belonging to the whole radiator surface 25 can also be separated from each other by a wavy structure, i.e. by a limitation or contour line 23 extending in wave-shaped manner (these wavy lines can be sine or cosine-shaped or take another wave shape).

With reference to FIG. 3*c* it is shown that the limitation line 23 between the two portions can also be in the form of a zigzag.

With reference to FIG. 3*d* it is only shown that the limitation line 23 can take any form in principle, for example it can also take a fractal structure.

As another possible embodiment, FIG. 3*d* shows that the lateral radiator surface portions 19 and/or the recess areas 20 between them, can have a fractal structure so that a limitation/contour line 23 following this fractal structure is created between the portions 19 and the recess areas 20. In this respect the configuration options for the lateral radiator surface portions 19 and the recess areas 20 are diverse and unlimited.

It emerges from the drawings, which are only shown by way of examples, that the lateral surface radiator structure 18 can have a large number of lateral radiator surface portions 19 and/or electrically non-conductive recess areas 20, which extend from the radiator surface 11 towards the ground plane 17 in finger, tongue, rectangular, triangular, trapezoid, comb, wave or similar shapes or, for example, be formed in the manner of fractal structures. Accordingly, the limitation and contour line 23 becomes larger as a result of this configuration, i.e. larger than simply the circumference of the substrate 3 along its lateral walls.

The described embodiment therefore shows that the annular or frame-shaped radiator surface 11 can ultimately be extended onto the outer surfaces of the substrate 3, i.e. onto the circumferential lateral or wall surfaces 3*c* whereby the volume of the substrate 3 is used to the optimum. Thus the whole radiator surface 25 can be enlarged without increasing the volume. As a result of the selected additional recesses or slits 20 between two corresponding lateral radiator surface portions 19 protruding towards the ground plane 17, the size of the annular or frame-shaped total radiator structure, especially the whole length of the limitation and contour line 23, can ultimately be further increased such that the cubic material of the substrate can be reduced by up to 50% and/or the bandwidth can be increased by up to 50%.

With reference to FIGS. 1 to 3*d*, it has been shown that the compact design of the antenna according to the invention not only can be improved by the use of the outer lateral surfaces 3*c* of the supporting body or substrate 3, but generally the enlargement of the whole radiator structure can be achieved through a wide range of measures and geometries on the lateral surfaces or lateral walls 3*c*. Moreover, in the case of the variants according to FIGS. 3*a* to 3*d* (which are only shown by way of example) the vertically polarised portion of the electromagnetic field (terrestrial gain) can be strengthened, since the finger-like lateral radiator surface portions 19 work as a whole like a comb, therefore functioning like small vertical radiator elements.

The supply structure of the described patch antenna will be explained hereinafter.

As can be seen especially from FIG. 1, the supply structure 15 consists of a quadrant circumferential strip 51, the eccentric feed point 53 being shown here, at which the antenna feeder line 42 (inner conductor) ends, which passes through a corresponding drilled hole 3*d* in the substrate 3 and a corresponding drilled hole 17*a* in the ground plane 17. In the process, the feeder line 42 can be an extension of an inner conductor 43' of a coaxial feeder line 43, the outer conductor 43" of which being electrically and galvanically connected to the ground plane 17. In the process, the quadrant circumferential strip 51 referred to generally constitutes a phase shifter device in the form of a phase shifter line 47.

Preferably, however, the embodiment is such that the described and shown patch antenna is positioned and connected to a circuit board LP, facing the upper side of which (i.e. the underside 3*b* of the substrate 3) a metallised surface is provided or constructed, which acts as a ground plane 17. Accordingly, the ground plane 17 shown in FIG. 1 can be provided as a correspondingly metallised surface on the upper surface of a possibly even larger circuit board. In the region of the feeder line 42, this metallised surface is provided with a recess, in the region of which the circuit board is provided with a drilled hole, through which the feeder line 42 is fed as far as the underside of the circuit board and electrically connected, in particular soldered, there. In this respect, the corresponding drilled hole in the circuit board can also be constructed as a through-connection, care simply having to be taken that no connection to the ground plane is made here. In this case there is therefore no coaxial connection line.

To this extent a view corresponding to FIG. 2 is shown in FIG. 2*a* in which the circuit board LP is also shown.

As a result of the eccentric arrangement of the feed point 53, this results in two different lengths of coupling lines 47' and 47" in the phase shifter line 47, which end centrally at the inner edge 11*a* of the annular or frame-shaped, i.e. circumferentially enclosed, radiator surface 11 in the embodiment shown, and preferably transition into central contact points 48 in the radiator surface 11 (the central connection of the coupling lines 47', 47" relating to the corresponding length of the respective inner side 11*a* of the recess, which is square shaped in this embodiment). As a result of the different lengths of the coupling lines 47', 47" thus formed, the required phase shift can be adjusted, e.g. to 90°, because of the different run times in the phase shifter line 47 thus formed. The circular polarisation of the patch antenna can thus be achieved.

As a result of the described construction with the present annular or frame structure of the radiator surface 11, the required circularity is not created via the described feed point 53 via discontinuities (fibres) in contrast to standard patch antennae, but rather through the phase shifter line 47 that has been created. This circumstance brings the advantage with it that the annular and/or frame-shaped radiator surface 11 can thus be extended onto the outer surfaces or lateral walls 3*c* meaning that the volume of the supporting body, i.e. the substrate 3, can be used to the optimum. As a result of the lateral surface radiator structure 18 with the lateral radiator surface portions 19 and the recess areas 20 referred to, the size of the annular and/or frame-shaped total radiator surface 25 can be further increased again, meaning that the volume of the supporter material—as already mentioned—can be reduced by up to 50%.

The supply structure 15 referred to and the phase shifter line 47, i.e. the coupling lines 47', 47" are provided or constructed (just as in the following embodiments) on the upper surface 3*a* of the substrate 3 or above it, normally therefore on the same plane as where the annular and/or frame-shaped radiator surface 11 is/are also located or arranged.

With reference to FIG. 4, an equivalent circuit diagram is also shown in addition, which indicates the annular or frame-shaped structure of the total radiator surface 25, an annular or frame-shaped radiator structure emerging from the lateral radiator surface portions 19 and the recess areas 20, which are constructed on the lateral walls 3*c* and follow on from each other alternately, said structure being defined by series inductivities 39 and series capacities 41 following on from each other alternately.

A patch antenna according to the invention constructed thus can be dimensioned accordingly by selecting suitable materials. For example, the patch antenna can be defined by the following materials and dimensions:

Outer dimensions: 25 mm×25 mm×6 mm
Slit or recess width (for the portions 20): 1.5 mm
Height of the overlapping area 35: 3.6 mm
Width of the lateral radiator surface portions 19: 2 mm
Distance of the central axis 7 to the feed point 53: 4 mm
Width of the phase shifter line 47 or coupling lines 47', 47": 2 mm
Lateral length of the recess 13: 14 mm×14 mm
Substrate material: plastic PPS $\epsilon_r$=3.2
tan(δ)=0.0007

Deviations from these values are of course possible within wide ranges. For example, deviations of preferably less than 50%, in particular less than 40%, less than 30%, less than 20% and in particular less than 10% can also lead to advantageous embodiments. The aforementioned corresponding values can, however, be larger as required, so that upward deviations in the range of preferably less than 60%, less than 70% . . . , less than 90% and in particular less than 100% (among others) are likewise possible.

With regard to the $\epsilon_r$ value of the plastic, these deviations can have a wide range of values especially upwards (in this respect there are no restrictions in principle). For example, the values for $\epsilon_r$ can preferably be between 2 and 20. In particular when the patch antenna according to the invention is to be used to receive programmes transmitted via SDARS, values for $\epsilon_r$ of between 2 and 10 are particularly suitable and in the process the substrate or patch antenna and thus the surrounding radiator surface has dimensions of 15 mm×15 mm to 30 mm×30 mm.

If the antenna according to the invention is to be used, for example, for receiving GPS signals, a substrate can be used with a material that preferably has values for $\epsilon_r$ of between 10 and 20. Patch antenna sizes, i.e. dimensions for the substrate in plan view, emerge here, which can be between 15 mm×15 mm to 25 mm×25 mm, for example. Between these values, any required different dimensions at 1 mm increments respectively are likewise possible and realisable.

With reference to the following FIGS. 5*a* to 5*h*, different supply structures 15 are now shown in schematic plan view, such that can be used for the square-shaped patch antenna (1) shown (in plan view) in FIG. 1.

In the case of the variant according to FIG. 5*a*, the supply structure 15, which can be seen in the embodiment according to FIG. 1, is shown schematically.

With reference to the additional drawing according to FIGS. 5*b* to 5*j* modifications are shown here, all of which merely indicate that many other structures are also possible.

In the case of the variant according to FIG. 5*b*, a right-angled line structure is proposed for the phase shifter line 47 with the two coupling lines 47', 47" instead of a quadrant, the feed point 53 referred to not being arranged in the corner area (which the central axis 7 cuts through) i.e. at the transitional area of the line branch, but rather displaced from the corner area in a line branch, resulting in different lengths of coupling lines 47', 47" to the central feed point 53 at the inner edge 11*a* of the radiator surface 11 again.

In the case of the variant according to FIG. 5*c*, a 270° circumferential, electrically conductive feed ring is selected as the phase shifter line 47, its coupling lines 47', 47", which ultimately extend from its feed point 53, ending at two contact points 48 offset by 90° on the inner side 11*a* of the annular or frame-shaped radiator surface 11 and thus being connected to the radiator surface 11. In the process, the supply is achieved from the feed point 53 (which is arranged centrally and through which the central axis 7 extends) via a first common radial feed branch 57, which then transitions into the two coupling lines 47 referred to extending in opposite directions from a branch point 57'.

In the case of the variant according to FIG. 5*d*, coupling lines 47', 47" extending at right angles with more than one angle are shown, the width of the coupling line and the length again being selected so as to be so different that a phase shift of 90° can be achieved in relation to the supply.

In the case of the variant according to FIG. 5*e*, a more complex construction is shown and specifically with intrinsically branching coupling lines 47', 47", the two coupling lines 47', 47" leading from the feed point 53 in the known manner via more than one angle to the connecting points 48 on the inner side 11*a* of the radiator surface 11. The connection points 48 are galvanically connected to each other again via two additional connecting portions 47*a*, 47*b*, which are perpendicular to each other, as can be seen directly in FIG. 5*e*.

With reference to FIG. 5*f*, it is shown that in contrast to the view according to FIG. 5*e*, capacitive supply is also possible in that the two coupling lines 47'. 47" of the phase shifter line 47 are galvanically separated from the radiator surface 11. In the process, the two coupling lines 47', 47", which extend perpendicular to one another and perpendicular to the lateral limits of the substrate 3 and the radiator surface 11, are aligned so as to be parallel to two connecting lines 47*a*, 47*b*, which are likewise arranged perpendicular and parallel to the coupling lines 47', 47" and are each connected in the process to the radiator surface 48 at a connection point 48 and to each other at their opposite ends. As a result of the parallel arrangement of these connection lines 47*a*, 47*b*, the capacitive coupling to the actual coupling lines 47', 47" of the phase shifter line 47 thus formed is achieved. The feed point 53 is also arranged eccentrically in relation again to the whole length of the phase shifter line 47, in order to achieve a 90° phase shift at the feed points 48 again, which is provided offset by 90° on the inner side of the radiator surface 11, as in the previous embodiments. The capacitive connection referred to on the annular and/or frame-shaped radiator surface 11 and the total annular and/or frame-shaped radiator surface 25 also causes an inclination of the gain beam by about 9° to 11°. In the case of inclined vehicle roofs in particular, this can be an advantage, in order to counteract a structural tilt on which the antenna is positioned.

The same applies in principle to the view according to FIG. 5*g*, the supply structure here reproducing a closed rectangular frame, two coupling lines 47', 47" leading from the feed point 53 to two 90° offset contact points 48, the electrical connection being made with the radiator surface 11. In the process, the two contact points 48 are connected to each other again via an additional connection line 47*a*, 47*b* (similarly to the embodiment according to FIG. 5*e*, the additional connection lines 47*a*, 47*b* being turned inwards effectively about the corner in comparison to the embodiment according to FIG. 5*g*).

The embodiment according to FIG. 5*h* is based on the variant according to FIG. 5*g* and is characterised by two additional central connection lines 47*a*, 47*b* extending in a crosswise direction, the coupling lines 47', 47" being connected to each other in addition and to the contact points 48.

With reference to FIGS. 5*j* and 5*g* it is only shown schematically that the contour of the substrate and of the radiator surface 11 does not have to be consistent with the interior contour of the recess 13. For example, in FIG. 5*i* a patch 11, which is square in plan view, is shown with a square substrate 3, which has a circular limiting edge for the recess 13. In the process, the phase shifter lines 47 are represented by two branches offset by 90° at the ends.

In the case of the view according to FIG. 5*j*, the patch and the radiator surface 11 are circular, whereas the limiting edge of the recess 13 is square. In this case the phase shifter line is part circular (in the manner of a 90° part circle). This is only intended to show that a wide variety of combinations and variants are possible here.

FIG. 6 is only intended to show schematically that the geometry of the patch antenna and of the substrate with the radiator surface does not have to be square (in plan view) either, but can also have deviating forms. Generally, a regular polygon is preferred.

With reference to FIG. 6 it is shown that the substrate 3 can be cylindrical, for example, and the radiator surface 11 on it and the inner circular recess 13 can be circular. Here also, two coupling lines 47', 47" are provided, starting from an eccentric feeder line 42—which ends at the feed point 53 of the phase shifter line 47—and offset by 90°, which are galvanically connected to the annular (generally frame-shaped) circumferential strip of the radiator surface 11 at the connection points 48 in order to create a 90° phase shift and thus to be able to operate the patch antenna as a circular polarised patch antenna—as shown with the other embodiments.

In this case a third radial arm 47*c* is formed, which serves to connect and couple, i.e. an electrically conductive strip portion 47*c*, which is connected to the radiator surface 11 symmetrically to the two coupling lines and ends at a preferably small distance 47*c* from the coupling line 47", which in this embodiment is the longer one, which extends to the feed point 53 (i.e. has two coupling portions at right angles to each other) the second coupling line 47' again extending radially up to the connection point of the annular radiator surface 11.

A patch antenna constructed thus can have the following values, for example:

Outer radius of the substrate/radiator surface 11 (measured from the central axis 7): 15 mm Inner radius 11*a* for the recess 13: 8.2 mm Total height of the substrate: 6.4 mm Distance of the feed point 53 to the central axis 7: 4.5 mm Height of the lateral radiator surface portions 19 in the overlapping areas 35: 4.6 mm Width of the recess 20: 2 mm Slit width 47'*c* between the third strip portion 47*c* and the first coupling line 47': 7.2 mm Width of the coupling line 47', 47": 2 mm Material of the substrate: plastic PS with a value $\epsilon_r$=2.5 tan(δ)=0.0001

Here too, appropriate deviations may be provided, such as already described above with regard to a substrate that has a basic square form or a patch antenna that is square in plan view. The same applies to the values of $\epsilon_r$. Instead of the dimensions of the basic square form referred to above, these dimensions for the present embodiment apply to diameters.

Reference is made hereinafter to FIG. 7, in which a modified supply structure, which is a variation of the embodiment according to FIGS. 1 to 6, is shown.

In this embodiment, in addition to a phase shifter line 47 with the two coupling lines 47', 47" a second phase shifter line 147, also extending from the feed point 53, is also provided and specifically with a second feed point 153, thus forming two additional coupling lines 147', 147", this phase shifter line 147 with the feed point 153 being arranged symmetrically in the sense of a 180° rotational symmetry to the central axis 7 in relation to the first phase shifter line 47 with the feed point 53 there and being connected to the radiator surface 11 at the connecting points 148.

The equivalent circuit diagram is shown in turn in FIG. 8.

In the case of the embodiment according to FIGS. 7 and 8, the two feed points 53 and 153 are supplied via a 180° hybrid phase shifter 253. Using this type of supply the bandwidth can be increased further. Furthermore, the directional characteristics of the antenna become symmetrical. The gain beam is no longer tilted here. In the process, the total supply of the 180° hybrid phase shifter 253 is performed via an inner conductor 43'" of a corresponding feeder line 43. In the process, the principle is comparable to the equivalent circuit diagram according to FIG. 4.

In the case of the variant described, the supply in relation to each feed point with its associated phase shifter line 47 or 147 respectively is therefore offset by 90° in relation to the surrounding radiator surface 11. In the case of both the variant according to FIG. 4 and the embodiment according to FIG. 8, the coupling lines 47', 47" and 147', 147" respectively extending from a feed point 53 and 153 respectively forming the respective phase shifter lines 47 and 147 do not have to extend offset by 90° to each pair of feed points 48 and 148. Instead of a 90° angular offset here in relation to the vertical or symmetrical axis 7, a 45° angular offset, a 30° angular offset or for example a 67.5° angular offset is possible if a corresponding phase shift via the respective associated coupling lines 47', 47" or 147', 147" respectively is selected. In each of these cases a circular polarised wave can be sent or received in principle.

In contrast to FIG. 2, FIG. 9 shows a cross-sectional view of a modified embodiment, for example of a patch radiator 1 that is square or cylindrical in plan view, which is constructed in the form of a truncated cone or truncated pyramid in terms of its overall shape, i.e. with lateral walls 3*c*, which do not extend perpendicular to the upper side or underside 3*a*, 3*b* of the substrate 3 and therefore perpendicular to the radiator surface 11, but rather inclined towards them. In the embodiment shown, the lateral walls are inclined at an angle α to the central axis 7, the angle α being formed between the base surface or underside 3*b* of the substrate 3 and the vertical sectional plane extending through the symmetrical or central axis 7. The lateral radiator surface portions 19 and the recess areas 20 located in between them, which are arranged alternately in the circumferential direction and have already been described many times accordingly, are on these now inclined lateral surfaces 3*c*.

The angle α can vary within wide ranges. It should, however, be larger than 0° because otherwise no three-dimensional substrate would be present effectively, but rather the whole radiator surface structure would only be on one plane. Values for α of more than 10°, in particular more than 20°, more than 30°, more than 40°, more than 50°, more than 60°, more than 70° and more than 80° are therefore desirable. Preferably this angle α is 90°.

These values could theoretically also increase to over 90° as shown schematically with reference to the slightly modified cross-sectional view according to FIG. 10. In the process, the structure of the substrate is shown effectively inverted in comparison to FIG. 9, the radiator surface 11 nevertheless being provided on the upper surface 3*a*. The lateral walls 3*c* are then inclined the other way round to the embodiment according to FIG. 9. In this case too, the angle α should preferably be smaller than 180° in order to form an actual three-dimensional substrate. Values of less than 170°, in particular less than 160°, 150°, 140°, 130°, 120°, 110° and in particular 100° are preferred.

Hereinafter it is shown with reference to three schematic vertical cross-sectional views comparable to those in FIGS. 2 and 2*a* that the overall radiator structure can, for example, also be formed using a metal plate, the lateral radiator surface portions 19 being at a distance from the upper surfaces of the lateral walls 3*c*.

In the process in the variant according to FIG. 11, a plate has been used which has been suitably stamped so that the uppermost portion of the radiator surface 11 can, for example, be affixed to the surface 3*a* of the substrate using an adhesive layer or a double-sided sticky tape. The previously stamped lateral radiator surface portions 19 have then been bent downwards on a circumferential edge 61 so that these lateral radiator surface portions 19 come to rest in the lateral surface or lateral wall area S, but are not constructed or positioned directly on the upper surface of the lateral walls 3*c*.

The lateral clearance A shown in FIG. 11 can be selected as required within wide ranges. In the process, the angle of the lateral radiator surface portions 19 can also vary so that these portions do not have to be arranged at a 90° angle to the upper radiator surface portion 11, as shown for two additional examples with dashed lines in FIG. 11, in that the lateral wall portions extend obliquely, namely at an angle α comparable to the embodiment according to FIG. 9.

In the variant according to FIG. 12, it is only shown that the lateral radiator surface portions 19 can be provided with at least one additional bend 19*b*, which is, for example, lower in comparison to the ground planes, in the lateral surface or lateral wall space S, extending parallel or at an oblique angle to the ground plane and ending with its free end on or at a distance from the lateral walls or lateral surfaces 3*c*.

With reference to FIG. 13, it is shown in a comparable vertical cross-section that the lateral radiator surface portions 19, which are provided in the lateral surface or lateral wall space at a distance from the lateral walls 3*c*, can also be provided with multiple bends 161 meaning that a type of surrounding stepped structure emerges, for example, in which at least predominantly more vertical portions alternate with more horizontal portions.

Particularly if an electrically conductive metal plate, which can be bent and angled as described, is used as the radiator or radiator structure, the corresponding recess 13 can be produced by stamping especially in the uppermost recess area, it being possible for the stamping process to be performed such that the necessary phase shifter lines 47 are simultaneously left behind in the stamping process and are then firmly bonded to the rest of the radiator surface as part of the whole radiator structure in one stamping process.

In the embodiments described, the lateral radiator surface portions 19 are constructed such that their circumference is electrically and galvanically closed. Optionally, simply point-shaped connections can also be provided in the corner areas between the lateral radiator surface portions 19 which are offset in the circumferential direction. Particularly if the patch antenna is produced using a metal plate that can be edged and stamped, the lateral radiator surface portions 19, which are turned down at the edge lines 61, can be separated from the adjacent lateral radiator surface portions 19 by stamped or edged lines especially in their corner areas.

Another variant of the invention according to FIG. 14 is referred to hereinafter in which the patch antenna using an edged metal plate is shown. The lateral radiator surface portions 19, which extend on the lateral surfaces 3*c* or at a distance from them, have emerged from a common stamped metal plate by means of edging in the upper corner area 61. In this embodiment, the phase shifter line 47 with the two coupling lines 47', 47" adjacent to the feed point 53 is also part of a stamped metal plate.

Furthermore, in the case of this variant even the feeder line 42 can also be produced as part of the stamped and edged metal plate, which forms the whole radiator structure; in order to create a corresponding length of feeder line, a recess area 149 emerges in the upper radiator surface 11 by means of the stamping process.

In this embodiment, four alignment pegs 97 are also provided on the upper surface of the substrate and preferably engage at corresponding points in drilled holes 97' made in the upper radiator surface 11 in the assembled position and thus serve to align the radiator surface 11.

According to the cross-sectional view according to FIG. 15, it can then be seen that the feeder line 42, which is thus constructed in the manner of a metal strip and extends downwards by means of edges, leads to a feed or solder connection point 83, where it can be galvanically connected to a circuit board LP (FIGS. 2 and 2*a*).

The recesses 98, which are visible in FIGS. 14 and 15, only have one point of relevance in terms of production technology, in order to be able to produce the substrate—if it consists of plastic, for example—such that it does not shrink, as far as possible.

Furthermore, with reference to FIGS. 16, 17 and 18 it is shown that the substrate 3 can have a hollow space 103, which is accessible from the underside 3*b* via an aperture 103*a* formed there. Thus a box-shaped substrate emerges from the uppermost cover 3*d* and the circumferential lateral walls 3*c*. As shown, for example in FIG. 17 and FIG. 18, an additional circuit board 107 can be accommodated in the interior thus formed, onto which electrical or electronic components or assemblies 109 can be positioned. In the process, the circuit board 107 referred to can be accommodated in this hollow space 103 at any required height, such as at roughly central height as shown, for example, in FIG. 17, or directly on the underside of the upper cover wall 3*d* in FIG. 18.

The whole interior or hollow space 103 is coated or clad with a metallised layer on the underside of the so-called cover 3*d* and on the interior lateral walls 3'*c*, thus the whole interior 103 is shielded to the side and upwards in relation to the substrate 3. Theoretically, an electrically conductive or metallised box or such consisting of a metal plate of a corresponding size could also be inserted into this hollow space 103.

Furthermore, it is shown in FIG. 18 that the patch antenna thus formed can be inserted into the circuit board LP via two drilled holes 117 using two spring devices 115 until the spring arms 117' engage into the aperture 117 of the circuit board LP and therefore retain the substrate 3 on the circuit board LP, already pre-aligned.

In principle, the described antenna can be used to transmit but also receive electromagnetic waves and in particular circular polarised electromagnetic waves. It can also be used for simultaneous transmission and reception in particular if the transmission and reception ranges are distinct from each other—if only slightly—in terms of frequency. During reception the corresponding signals are then passed on to the electronics located on the circuit board and/or other subsequent assemblies via the so-called feeder line for further processing.

The described embodiments show that two 3D ring patch antennae can be arranged one nested in the other in order to receive GPS and SDARS signals, for example, at relatively low cost. The low-cost construction also emerges among other things because no ceramic is necessary as a dielectric for the patch antenna arrangement. Furthermore, a relatively compact construction can be achieved. Moreover, the S parameters, gain and axial ratio meet the requirements.

With reference to FIG. 19 et seq., another modification of the solution according to the invention is now shown in the form of a stacked patch antenna, in which the antenna structure described thus far according to the described annular or frame-shaped patch antenna forms a first or outer patch antenna A, below or within which another patch antenna B is arranged, which is more or less totally overlapped or enclosed by the first patch antenna A. Thus a capacitive coupling emerges between antennae, which makes it possible for the whole antenna structure to be further reduced in size without the performance of the antennae suffering. In other words, the radiator surface (211 in the second patch antenna B) is arranged in the clearance between the radiator surface 11 of the first patch antenna A and the ground plane 17, in particular in a central area of 20% to 80%, in particular 30% to 70%, especially 40% to 60% of the total height or total clearance between the radiator surface 11 of the first patch antenna and the ground plane 17.

In other words, an improved bandwidth and improved gain emerges from the following embodiments particularly in the case of GPS antennae. Moreover, a cost saving can be achieved in comparison to conventional solutions of corresponding stacked patch antennae since the antenna structure can preferably consist of just two plates and a plastic support.

In the process with reference to FIG. 19, the basic construction of the stacked patch antenna arrangement is shown in a three-dimensional view and in FIG. 20 in an exploded view.

In the process in FIG. 20, the patch radiator A can be seen uppermost as already described in principle with reference to FIG. 1 et seq. In the process, the patch radiator A can be formed from a metal plate by stamping and edging. Accordingly, a recess 11' can be seen in the surrounding annular or frame-shaped patch radiator surface, said recess only emerging in order to be able to produce the feeder line 42 shown between the two phase shifter lines 47', 47" in sufficient length likewise by means of stamping so that the feeder line extends through the whole antenna arrangements after edging at a sufficient height preferably to the lower area of the support arrangement.

In FIG. 20, the second patch antenna B can now be seen in the centre which, in the preferred embodiment shown, is constructed such that the patch antenna A and the patch antenna B have a comparable antenna structure.

This means that the second patch antenna arrangement B has a radiator surface 211, which is annular or frame-shaped, a lateral surface radiator structure 218 being provided on the circumferential sides, which consists of a large number of lateral radiator surface portions 219, between which recesses 220 are provided, which have open ends on the side turned away from the radiator surface 11 in the embodiment shown. Since in this respect both antennae A and B can be constructed the same, the corresponding structural features of the patch antenna B are provided with the same reference numerals as the patch antenna A but higher by 200. In this case too, the radiator surface 211 can be stamped from a metal plate or metal part and parts edged, a supply structure 215 likewise being constructed in turn in the recess area 213 with two phase shifter lines 247' and 247", between which the similar feeder line 242 likewise extends in turn preferably transverse and preferably perpendicular to the plane of the radiator surface 211. Here too, a corresponding additional recess 211' is provided in the radiator surface 211, which makes it possible for the corresponding feeder line 242 to be stamped in sufficient length from the metal plate and by means of edging can preferably be folded down extending perpendicular to it so that the feeder line can be guided in sufficient length downwards through the support structure to the other side. In the process, the two phase shifter lines 247' and 247" end respectively at two connection points 248 on the inner edge of the radiator surface that is provided with the recess.

At the very bottom of FIG. 20 the support structure 10 can be seen, which consists of a dielectric material. The support structure 10 comprises a support device 300 with a surrounding wall 301, wall portions 302 and platforms 303, which end at different heights, then being provided inside this support structure. Thus the second lower or inner patch antenna B referred to can be placed or fixed at a lower plane or a lower level whereas the patch antenna A can be mounted at a higher level overlapping the patch antenna B, the upper radiator surface 11 therefore being located further away from the ground plane than the radiator surface 211 of patch antenna B.

In order to allow simple assembly, the second patch antenna B is provided in the regions of its annular and/or frame-shaped radiator surface 211 with a locking device 311, which can consist of more than one individual finger extending towards the centre in a radial direction. This facilitates placing the patch antenna B thus formed onto the assigned support portion of the support device 300, locking elements 313 then preferably also being constructed at corresponding support portions as part of the support device 300 per se, which can be mushroom-shaped so that the finger-shaped locking elements 311 can lock underneath them and the lower patch antenna B is held tight and securely on the support device 300.

It can also be seen here that the support device 300 is designed in the form of a dielectric with the walls or wall portions and platforms, etc. acting as the support such that a circumferential groove-shaped recess or depression 321 is formed for the lower patch antenna B in which they can extend downwards transverse and at least almost perpendicular, for example at an angle of 91° to 95°, to the radiator surface. In the process, the lateral radiator surface portions 219 are preferably positioned slightly outside and abut the inner lateral surface 300' of the support device 300 when placed on top and fixed, thus achieving an additional firm fit of the inner patch antenna B.

Figure 22:
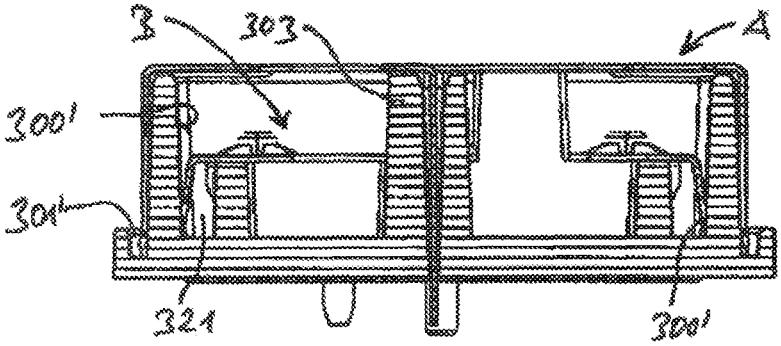
FIGS. 22 and 23 show two cross-sectional views of the lines A-A and B-B respectively from FIG. 21.
Figure 23:
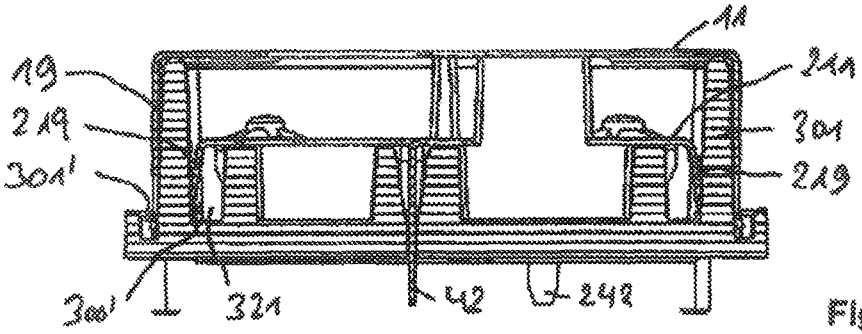

The sectional views according to FIGS. 22 and 23 also show that the support structure 10 and the support device 300 show a circumferential groove 301' with a low height opening upwards on the outside on the outer wall 301 in the region of its lower base into which the leading ends of the radiator surface portions 19 can engage into the upper patch antenna A, which otherwise abut the outer surface 300" of the outer wall 301 of the support structure 300. Furthermore, it can be seen in the process that small hooks 307 (FIG. 20) are constructed in the outer surfaces 300" of the circumferential wall 301 especially in the corner areas, and that the radiator surface portions 19 provided in this region are provided with corresponding interacting locking elements 19' (FIG. 20) in the form of recesses in the embodiment shown, which engage with the hooks 307. Thus the outer or upper patch antenna is fixed to the support structure 10, i.e. the support device 300, with the simplest of means.

Figure 24:
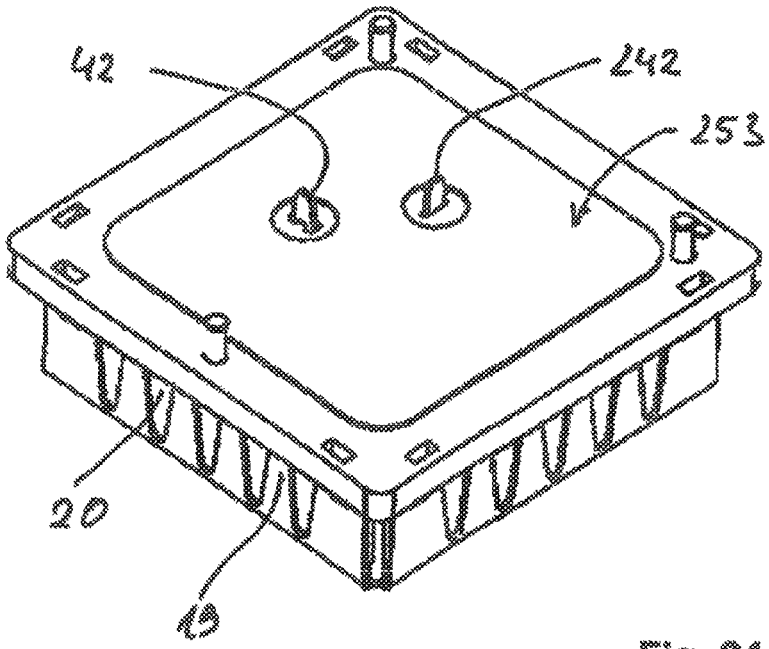
Figure 25:
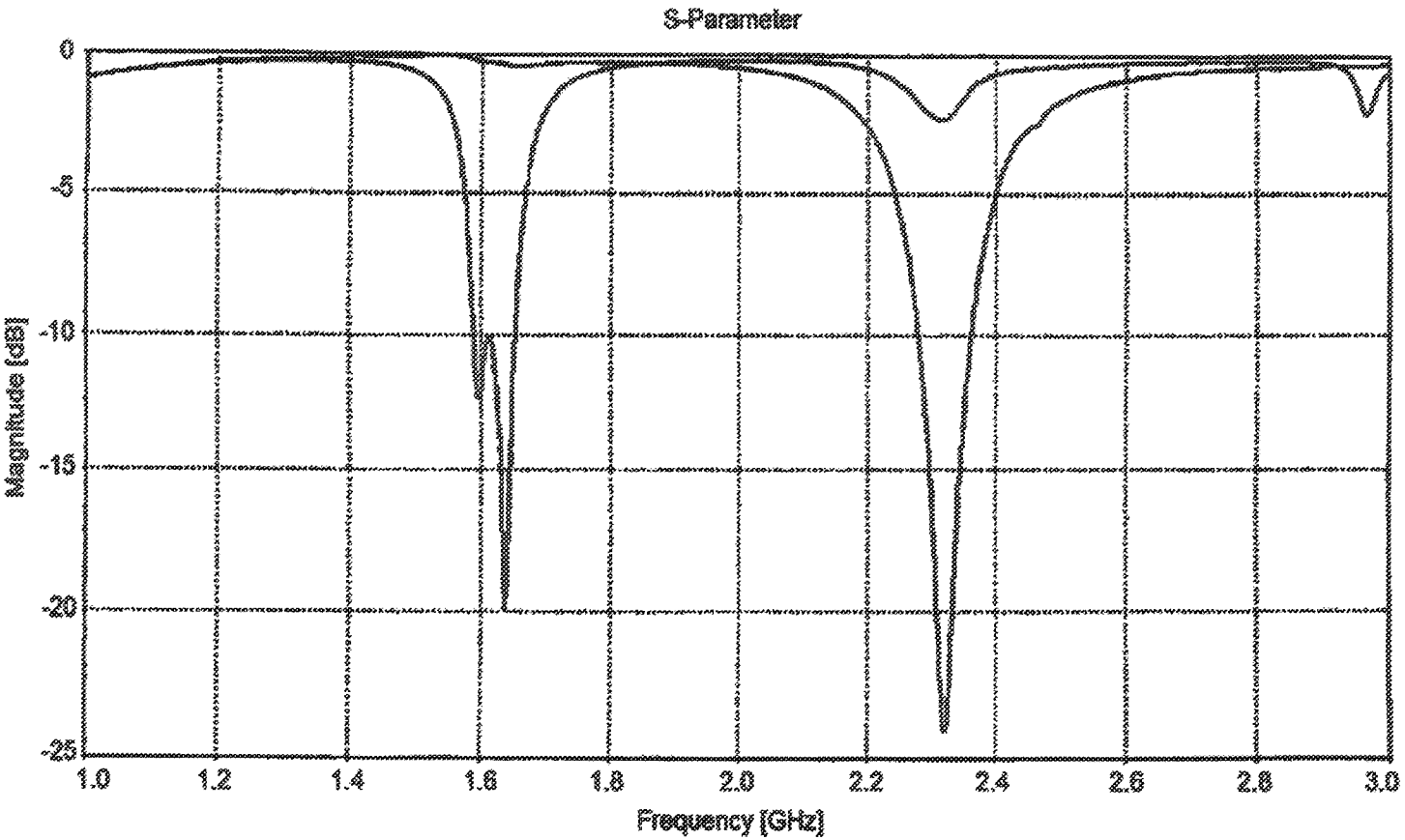

With reference to FIG. 24, a view from underneath the described antenna arrangement is shown, which can be provided with an adhesive tape 253 in order to bond the patch antenna arrangement thus formed at an appropriate position, for example on a chassis. The two feeder lines 42 and 242 can also be seen in this arrangement. In order to achieve or position these feeder lines in an unimpeded manner, the two patch antennae A and B are preferably aligned with respect to their phase shifter lines such that each respective pair of interacting phase shifter lines 47' and 47", and 247' and 247" respectively are offset against each other by 180° in plan view, i.e. are diametrically opposed. Using an antenna of this kind now allows a patch antenna arrangement to be achieved in which, for example, two circular polarised patch antennae can be provided in the smallest installation space, it being possible, for example, for the upper or outer patch antenna to act as a GPS ring antenna and the lower or inner patch antenna as a SDARS ring antenna. A corresponding resonance diagram for the two antennae is shown in FIG. 25.

In this embodiment, the variant of the two patch antennae A and B can be finely adjusted so that the patch antenna A, i.e. the outer antenna A or the antenna A, which overlaps the whole antenna arrangement, is suitable for receiving signals, which are transmitted, for example, by a Global Navigation Satellite System (GNSS), whereas the lower or inner patch antenna B can be used, for example, for receiving SDARS satellite signals.

Figure 20:
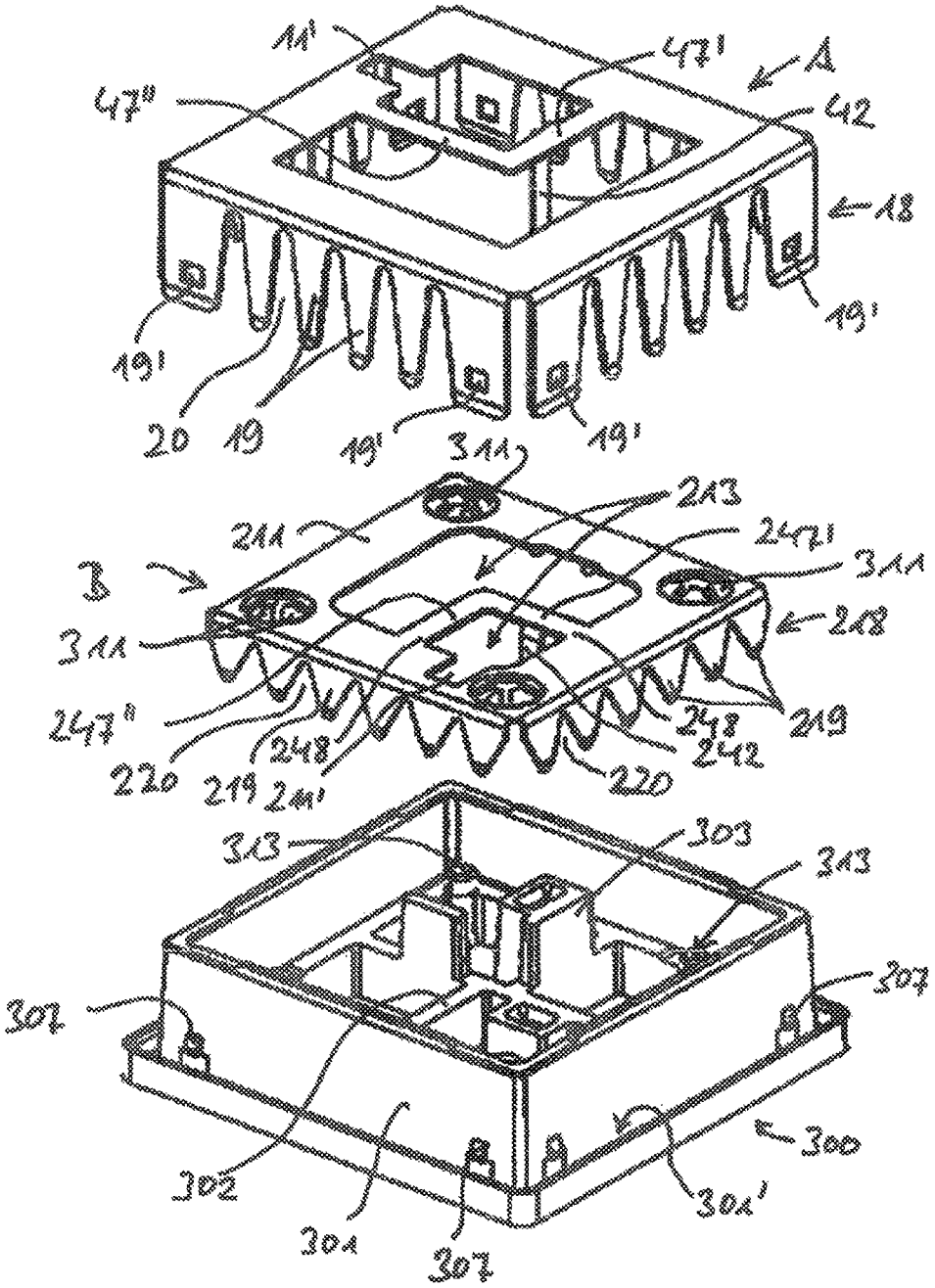
Figure 21:
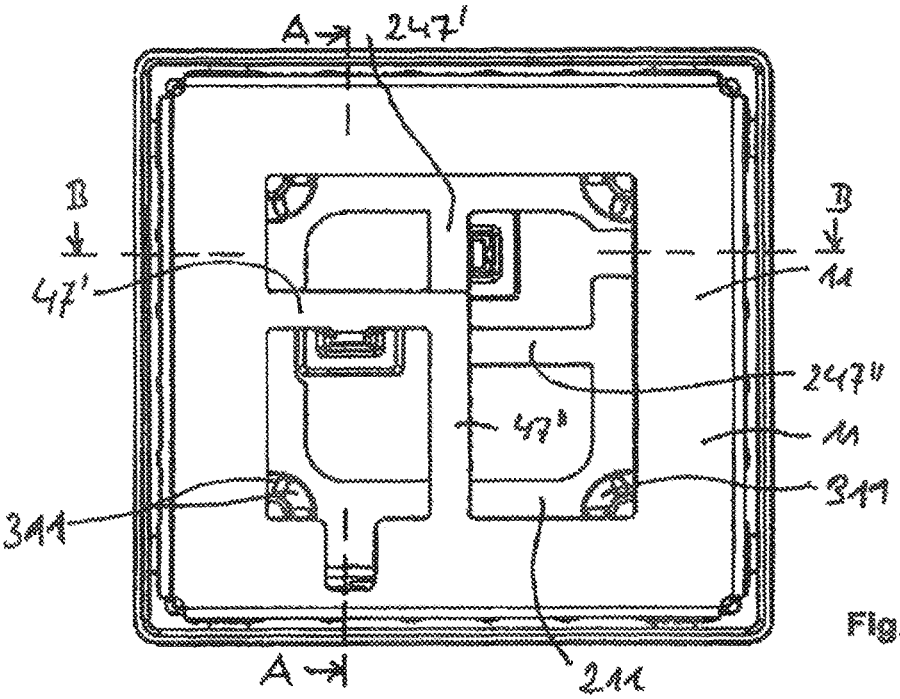
FIG. 21 shows a schematic plan view of the embodiment according to FIGS. 19 and 20.
Figure 26:
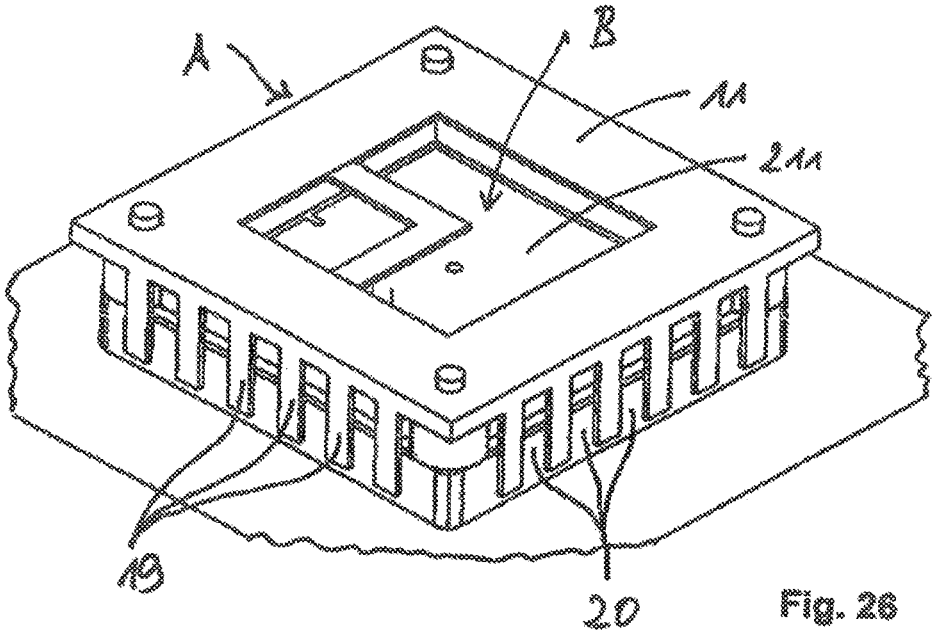
Figure 27:
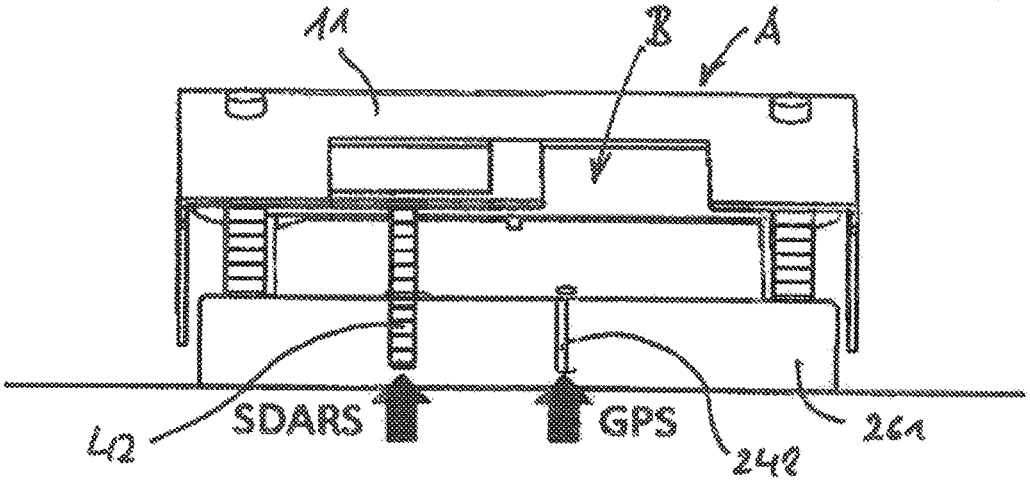

In contrast to FIG. 20, it is shown with reference to FIGS. 26 and 27 that the second patch antenna B can also be constructed in a simplified embodiment as a single polarised patch antenna, where the radiator surface 211 is constructed, for example, as a continuous surface (e.g. without a recess).

Figure 1:
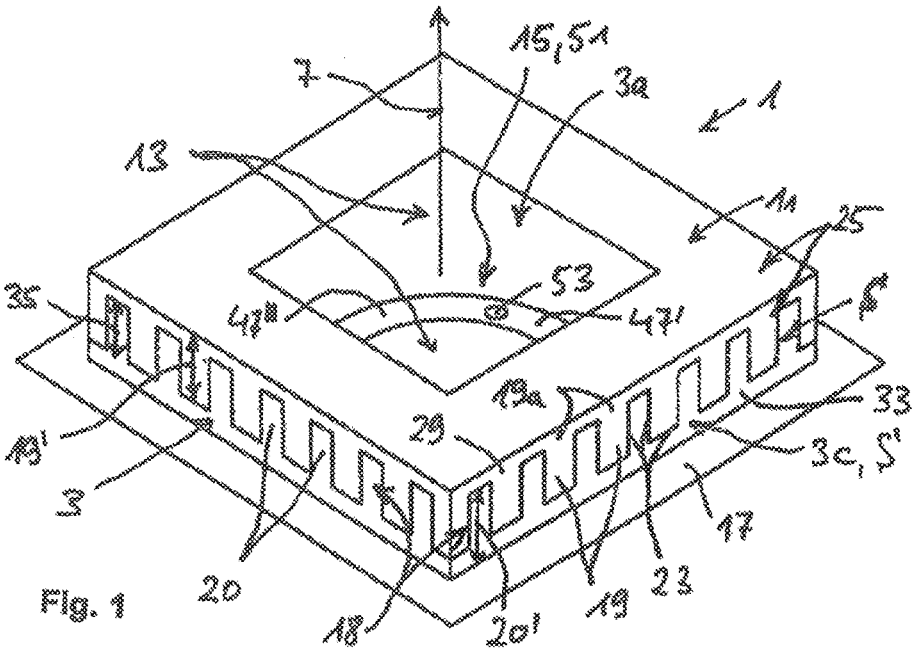
Figure 2:
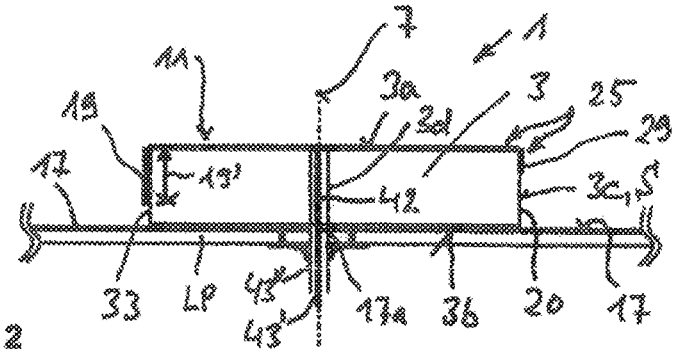
Figure 2A:
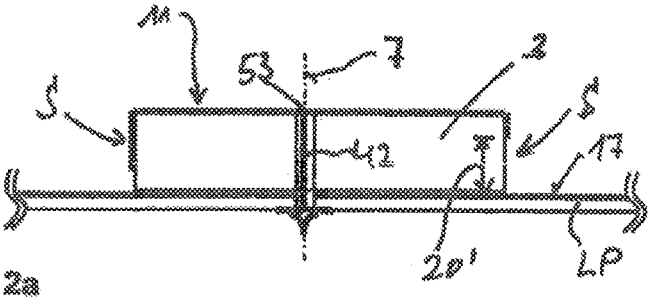
Figure 3A:
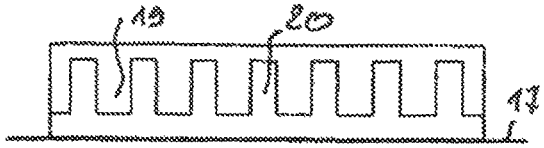
Figure 3B:
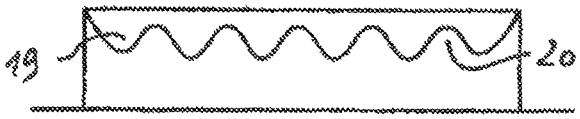
Figure 3C:
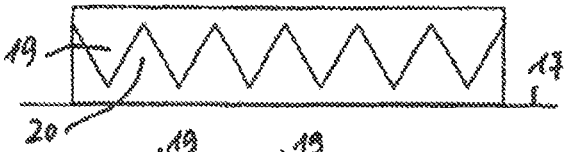
Figure 3D:
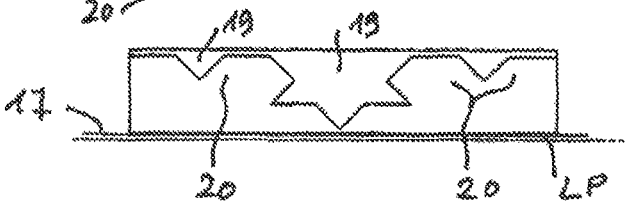
Figure 4:
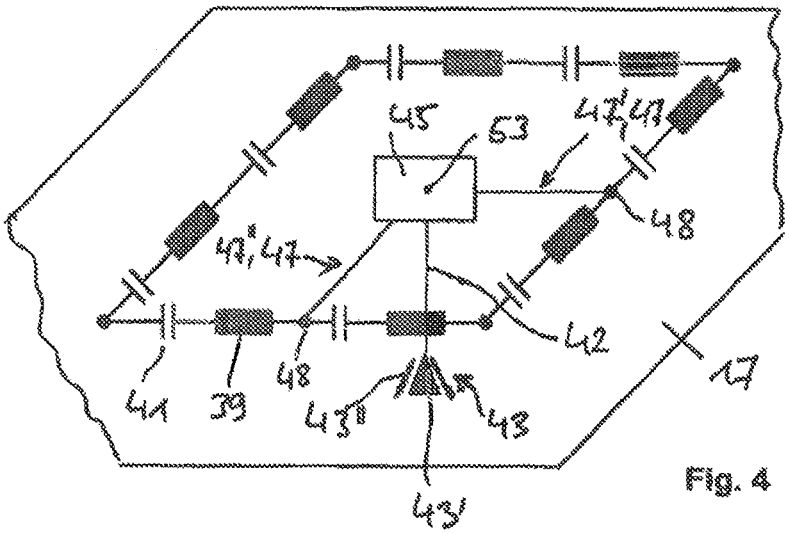
Figure 5A:
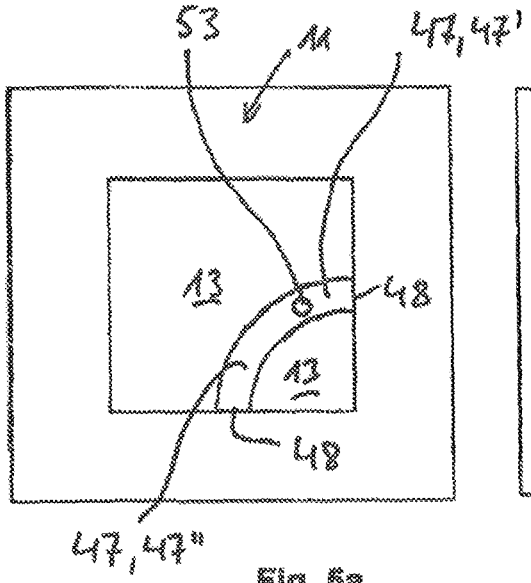
Figure 5B:
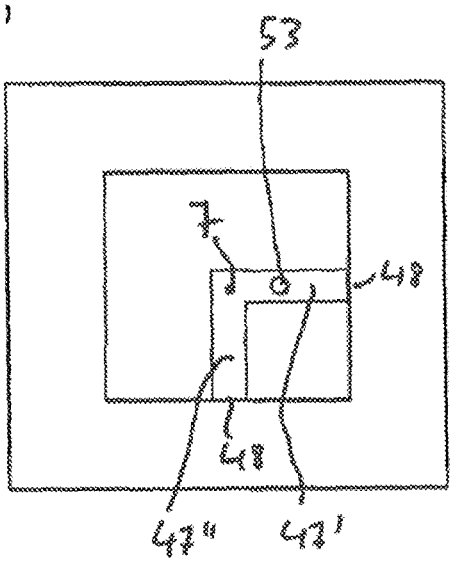
Figure 5C:
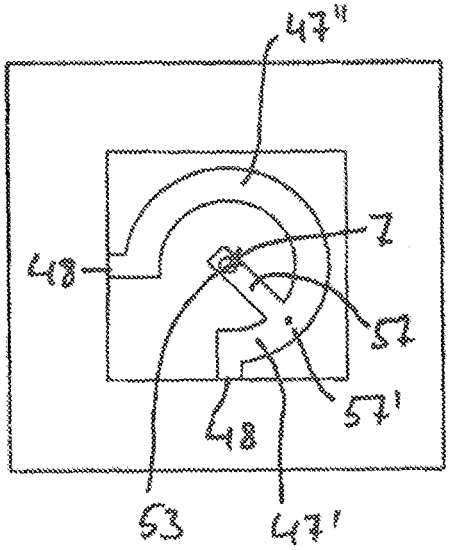
Figure 5D:
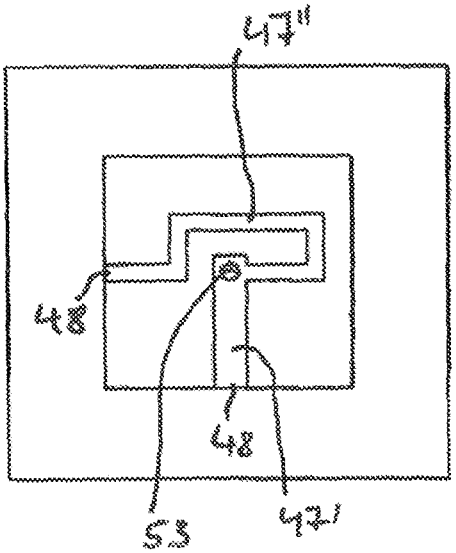
Figure 5E:
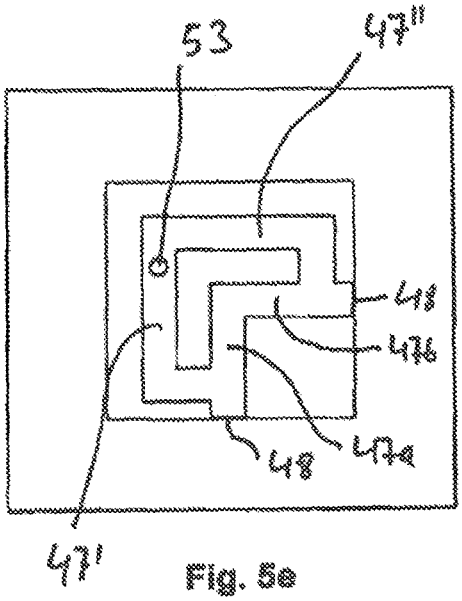
Figure 5F:
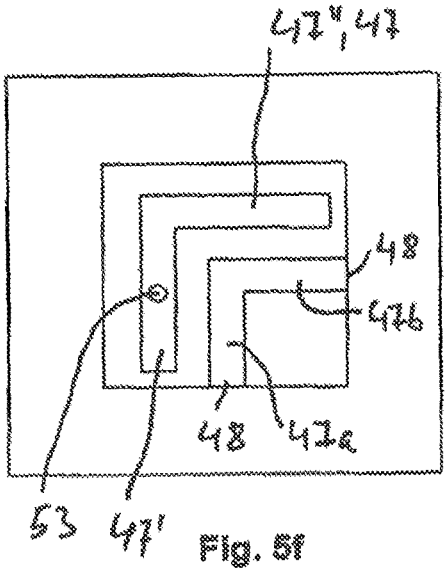
Figure 5G:
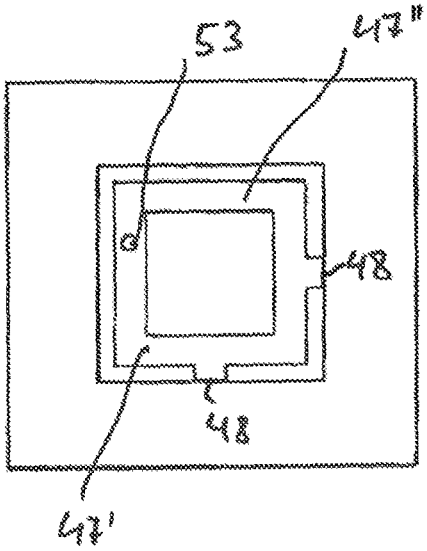
Figure 5H:
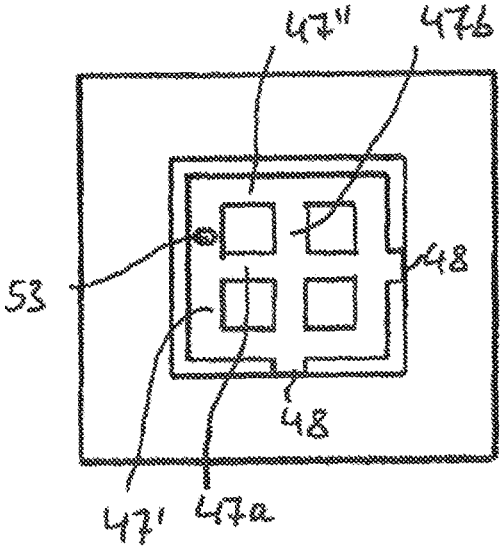
Figure 5I:
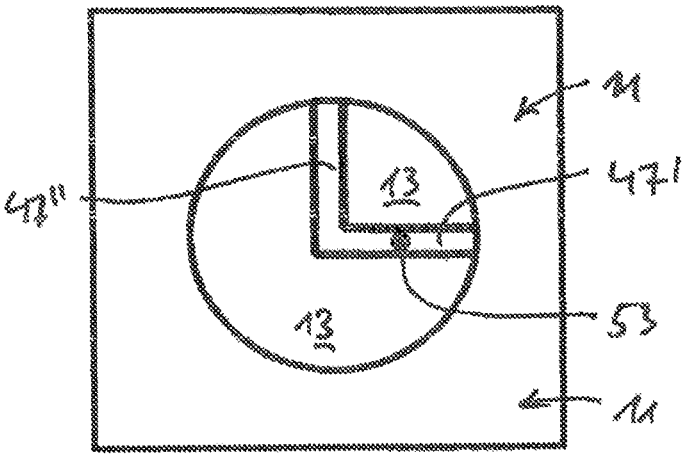
Figure 5J:
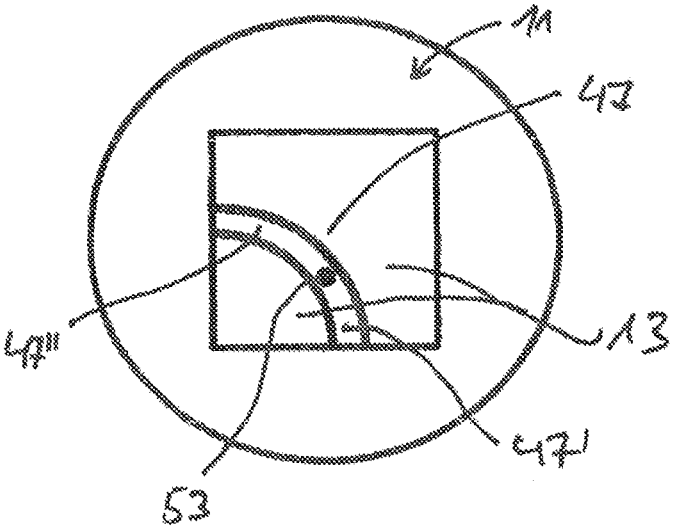
Figure 6:
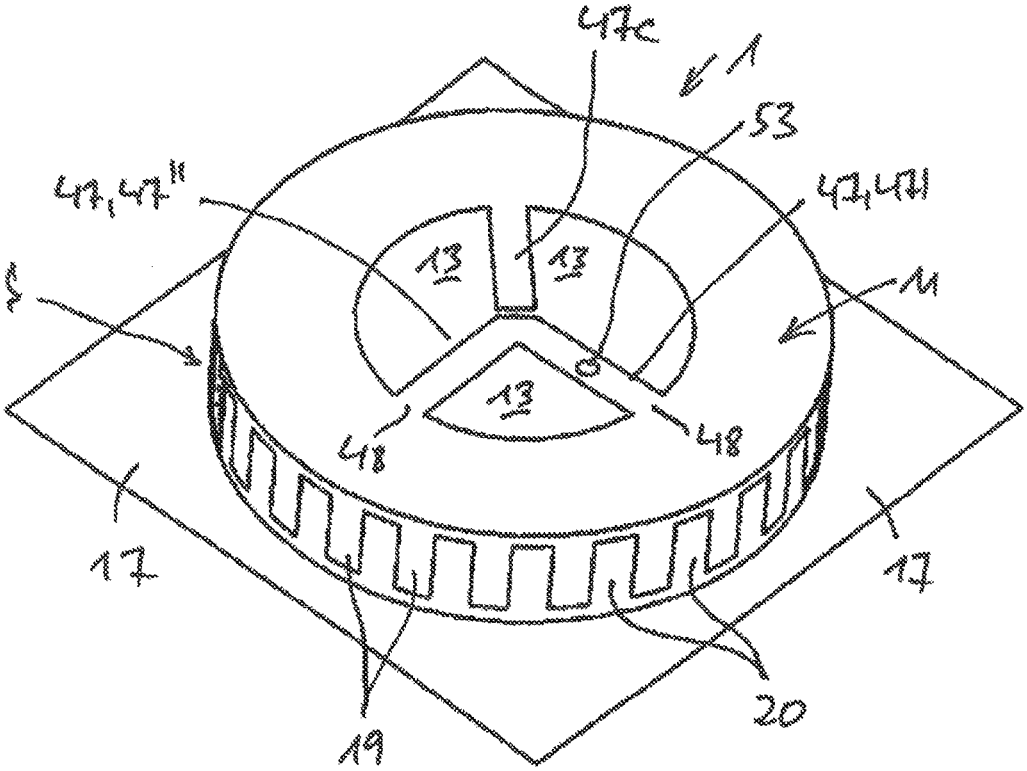
Figure 7:
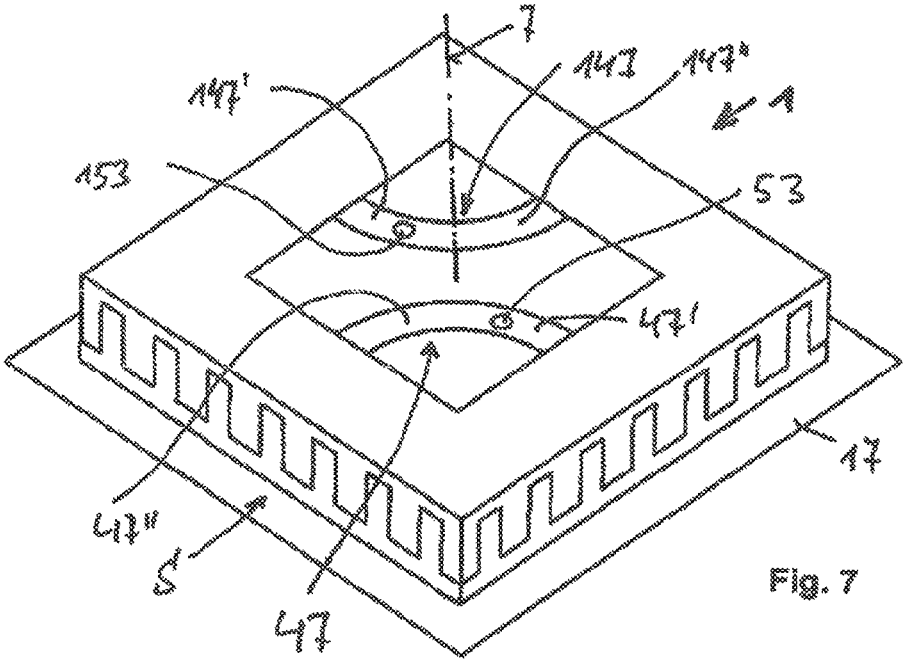
Figure 8:
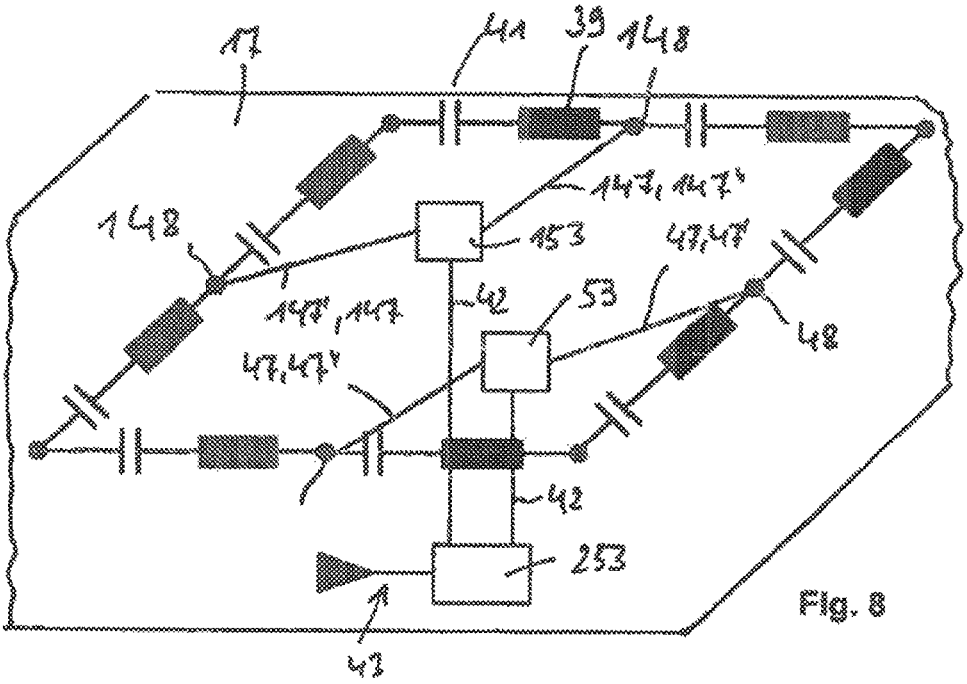
Figure 9:
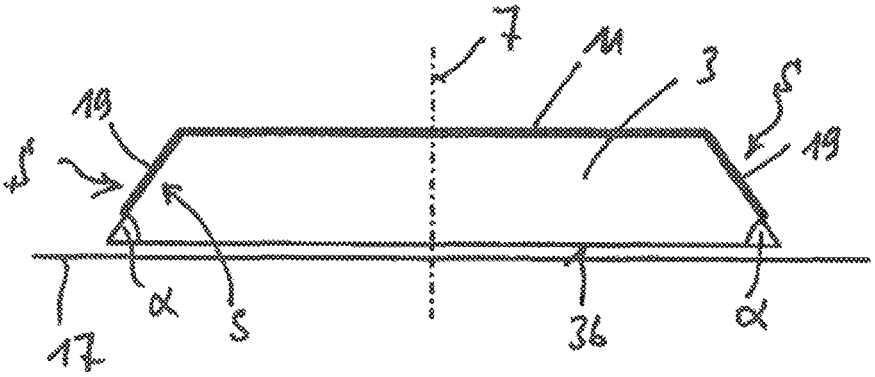
Figure 10:
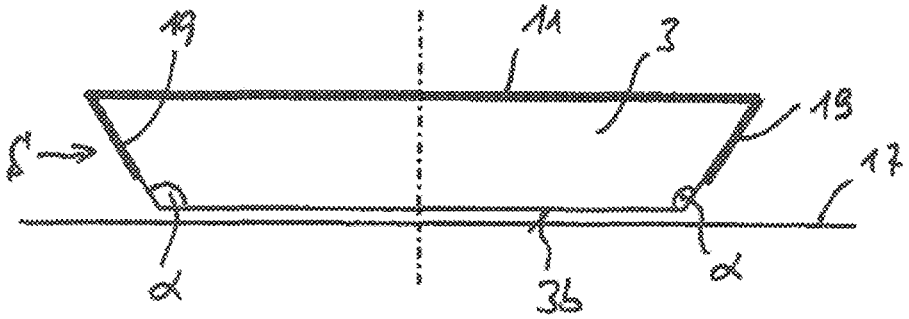
Figure 11:
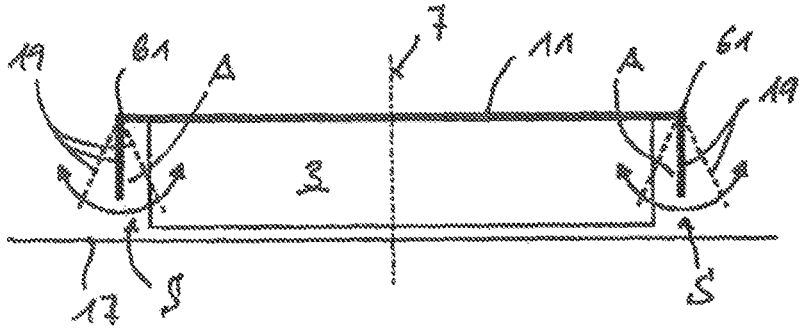
Figure 12:
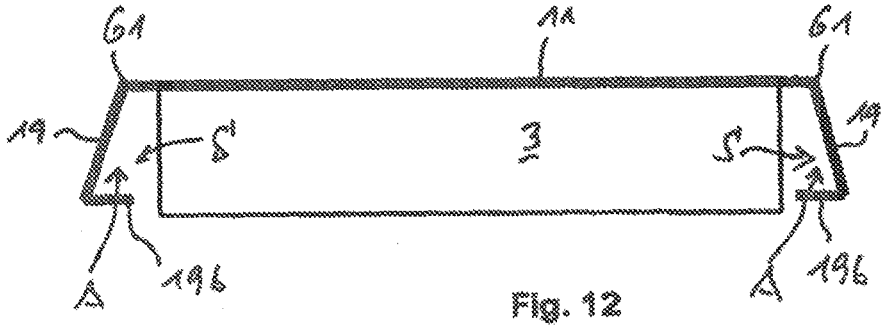
Figure 13:
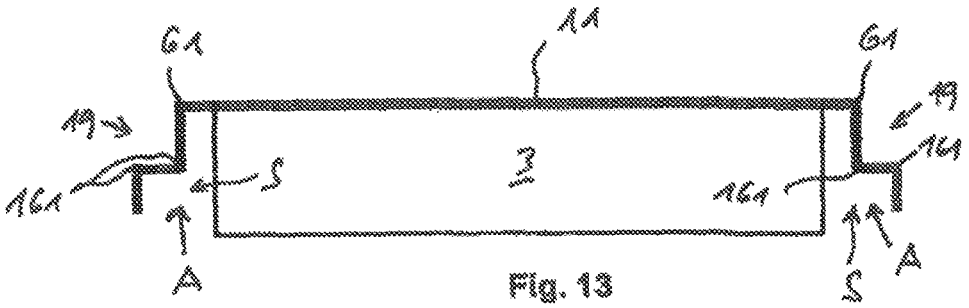
Figure 14:
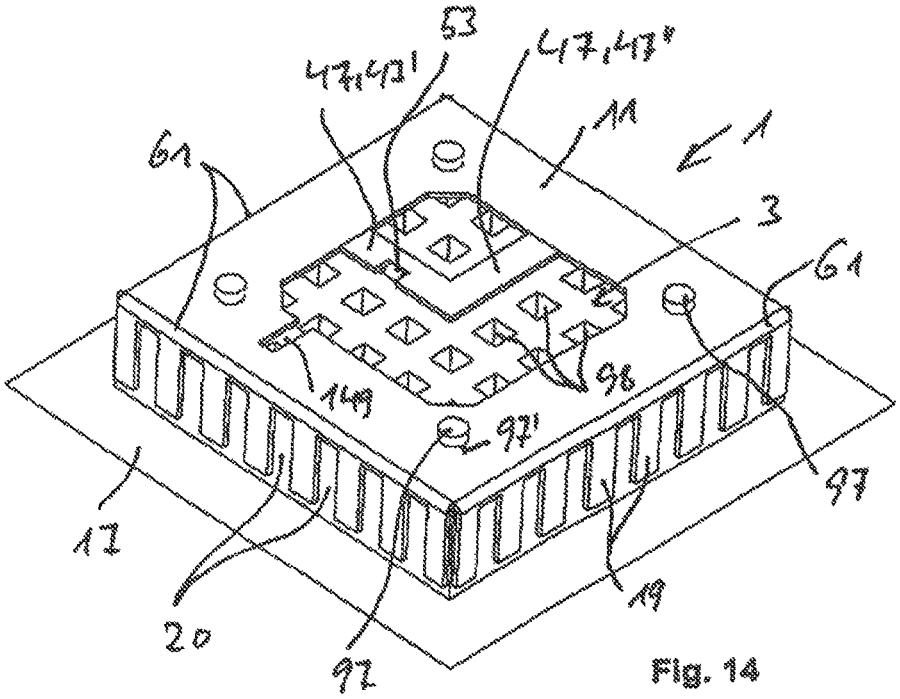
Figure 15:
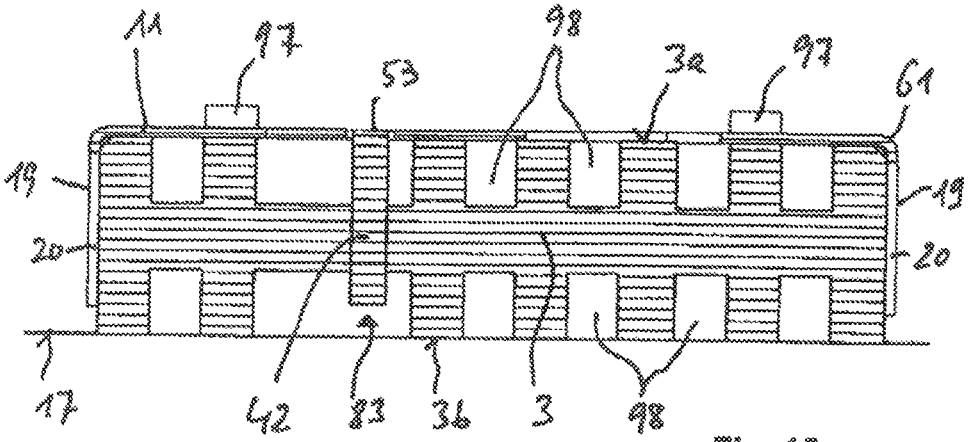
Figure 16:
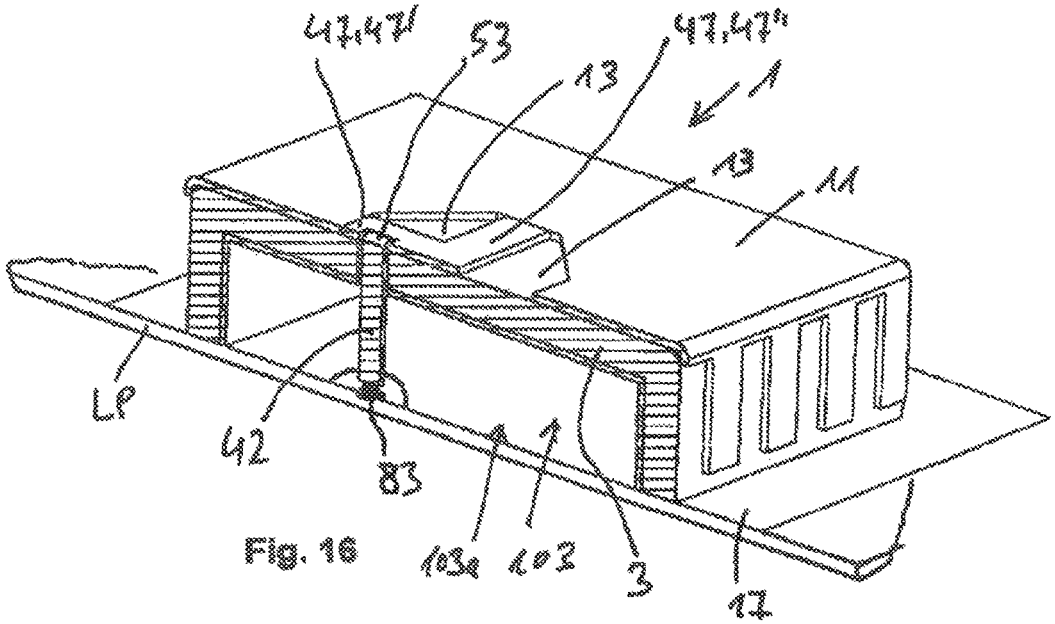
Figure 17:
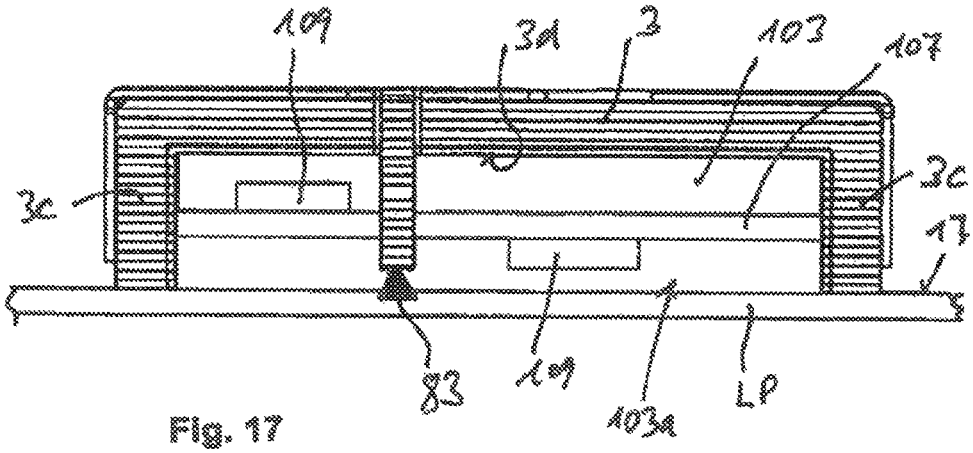
Figure 18:
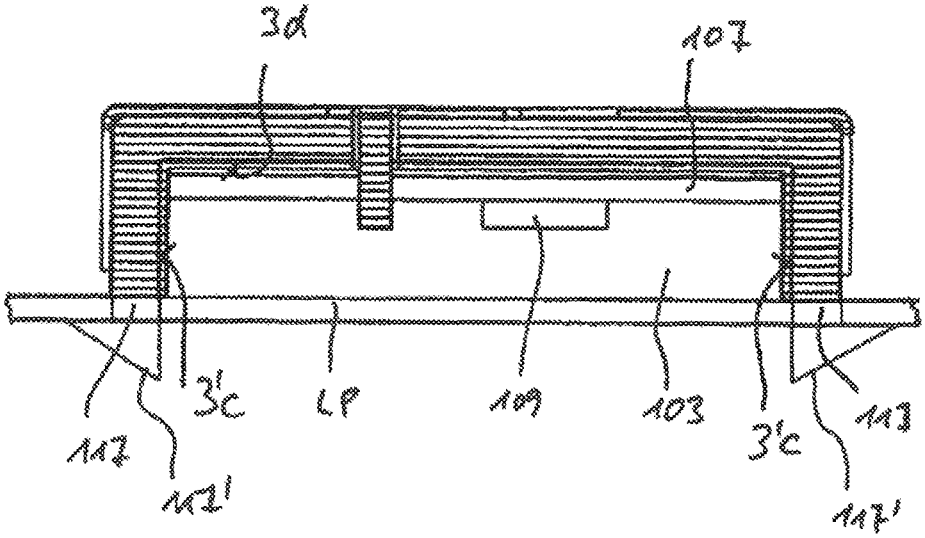
Figure 19:
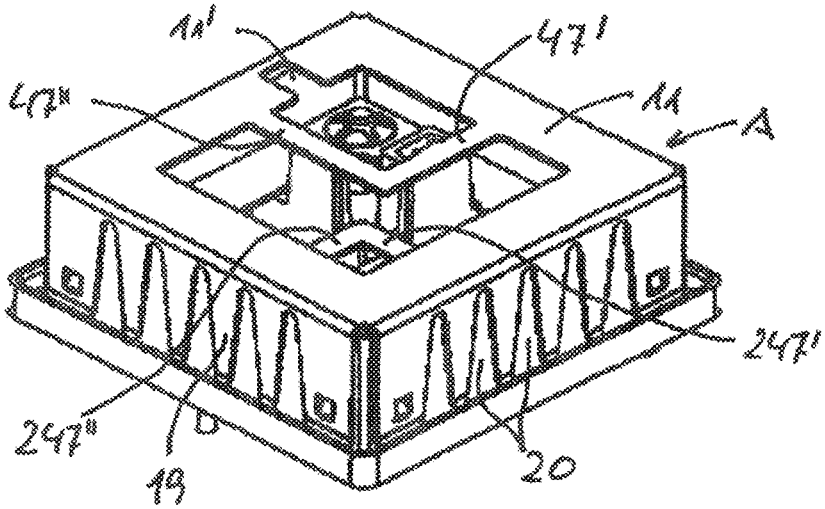

In this case, the lower or inner patch antenna B can, for example, comprise a more or less continuous radiator surface, which is constructed on the upper surface of a dielectric 261 that fills the volume, for example of a cuboid or similar-shaped dielectric 261. Here, for example, a patch antenna can be used where the support body of the dielectric of the patch antenna B consists of ceramic (in the process the ceramic used can have a value for $\epsilon_r$ of 20 to 45). There is then another support 300 surrounding this ceramic body in the form of a plastic frame with more or less circumferential support walls 301 according to the embodiment according to FIGS. 19 and 20, it being possible for this dielectric material to have a value for $\epsilon_r$ of 2 to 6, for example. In this way the radiator surface of the first patch antenna A is retained and supported in the described manner.

Thus a ceramic part associated with the outer or upper patch antenna (preferably in the form of an SDARS antenna) is omitted; thus a cost saving is achieved. The outer patch antenna, in particular in the form of an SDARS antenna, is preferably achieved by means of a simple sheet metal structure. In the process a high bandwidth AR can be achieved, which has ≤3 dB of 2320 MHz to 2345 MHz, for example. Thus interoperable data transmission according to the Sirius/XM standard is guaranteed.

Moreover, the outer or upper patch antenna, preferably in the form of an SDARS receiver antenna, improves the reception performance of geostationary positioning data, i.e. for example within the scope of a Global Navigation Satellite System (GNSS) and in particular of receiving the GPS positioning data. In the process, a gain on the zenith of 4 dB (Gen Patch Solo=3 dB) can be achieved, for example, at a higher bandwidth AR with ≤7 dB (AR Patch Solo≤11 dB).

If, for example, the whole outer patch antenna arrangement A has outer dimensions of 27×27×8 mm, the inner patch antenna B, preferably functioning as a GPS patch antenna or similar, can have outer dimensions of 18×18×4 mm, for example, or 25×25×4 mm, for example. In other words, all suitable in-between dimensions below or above the outer dimensions referred to are feasible and provide surprisingly good results.

Likewise, the second radiator surface 211 of the second patch antenna B shown with reference to FIGS. 26 and 27 could be constructed with a lateral surface radiator structure 218 with a large number of lateral radiator surface portions 219 on the circumferential edge, as in the embodiment according to FIG. 20. The radiator surface 11 could ultimately also be constructed like the embodiment according to FIG. 20, namely creating a dual or circular polarised antenna, for example using the two phase shifter lines 247' and 247" shown there but without the circumferential lateral surface radiator structure 18. Modifications are possible here.

Figure 28:
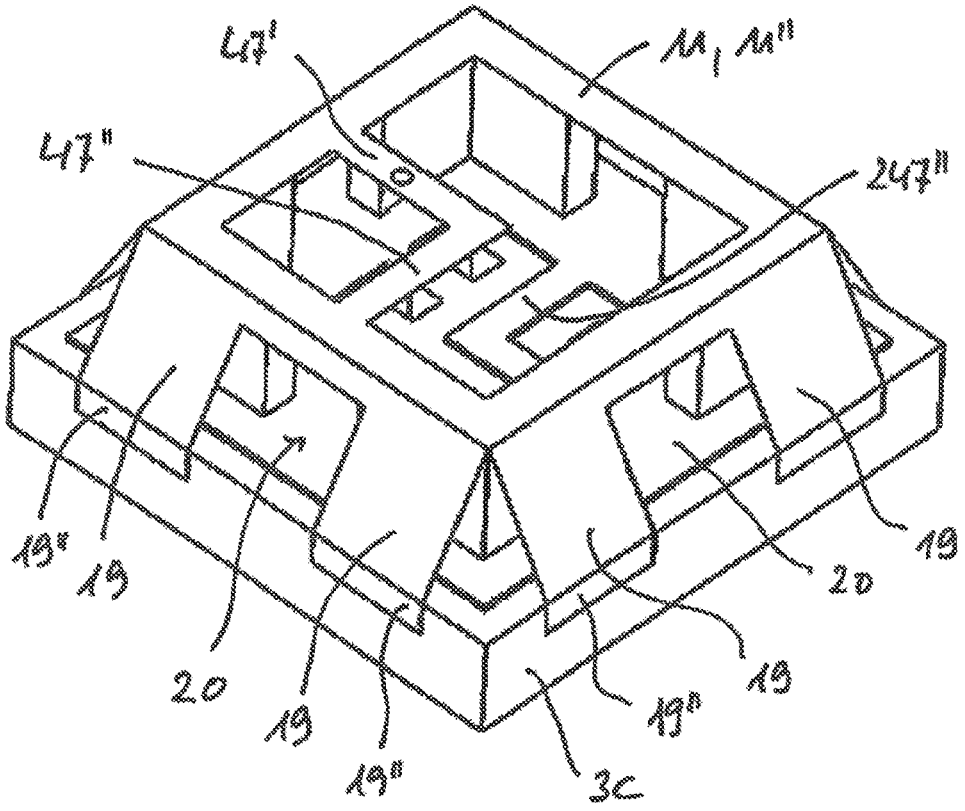
Figure 29:
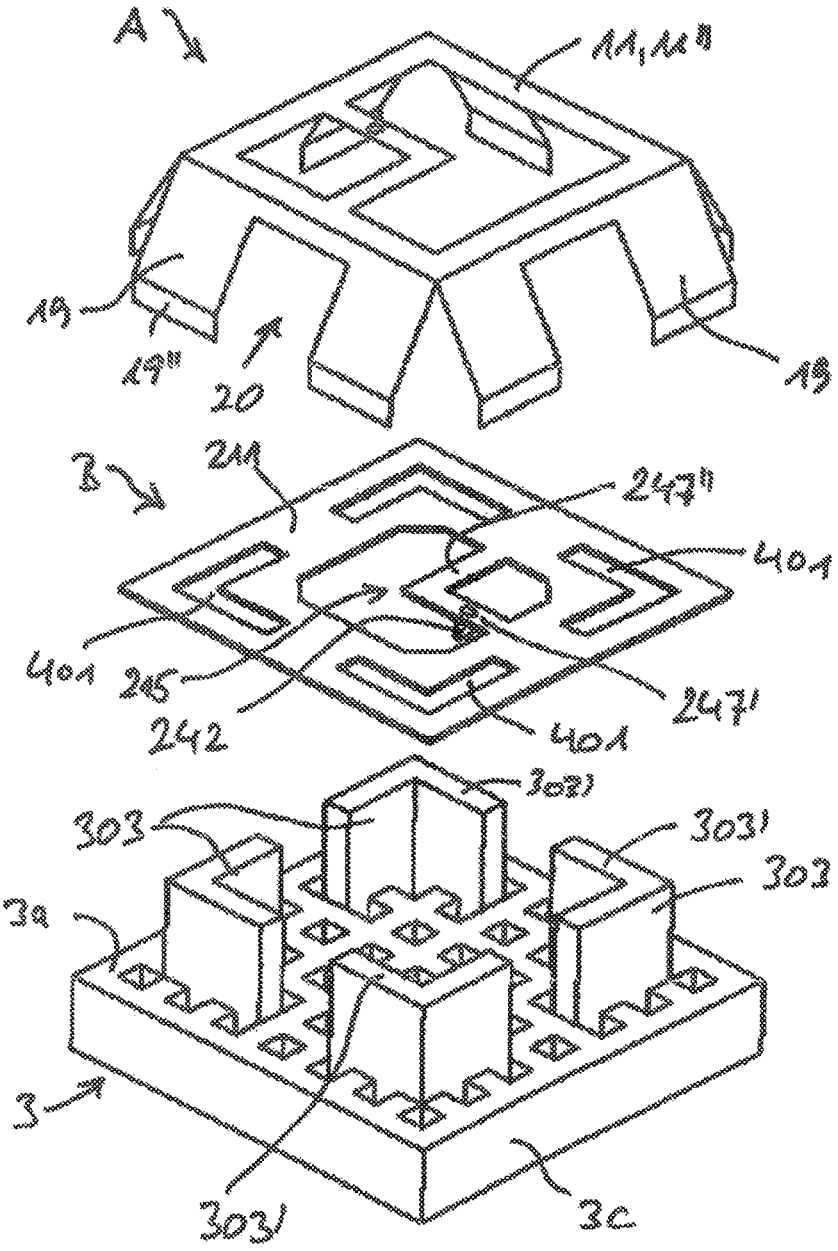

Finally, reference is made to another embodiment shown in FIGS. 28 and 29, the additional embodiment in FIG. 28 being shown in a three-dimensional view and in FIG. 29 in an exploded view.

In the case of this variant too, an effectively three-dimensional patch radiator A is provided, which is basically constructed as in all the other preceding embodiments. The radiator surface 11 is frame-shaped, the width of the radiator surface frame 11" being kept relatively narrow in this embodiment. Lateral radiator surface portions 19 are again constructed on the circumferential edge of the radiator surface 11. In the embodiment shown, two lateral radiator surfaces 19 are provided per long side of the radiator surface 11 offset against each other in the longitudinal direction of the side concerned, which are relatively wide, i.e. have a width that roughly corresponds to the clearance between the two lateral radiator surface portions 19 per long side of the radiator surface 11. These lobed or tongue-shaped lateral radiator surfaces 19 do not extend vertically but rather outwards at an oblique angle away from the radiator surface 11, i.e. in an arrangement diverging from the radiator surface 11 towards the substrate 3, the end portions 19" of the lateral radiator surface portions 19 in the embodiment shown overlapping the lateral walls 3*c* of the plate-shaped base of the substrate 3 at least to a partial height ending and abutting there parallel to the lateral wall 3*c*.

Inside the basically plate-shaped substrate 3, platforms 303, i.e. platform-shaped, elevated, angular spacers 303 are provided, which are arranged in the respective corner areas displaced inwards towards the outer surface of the substrate. They all end at the same height.

In the embodiment shown, the second patch antenna is now not three-dimensional but rather constructed as a flat level patch antenna only. In principle, this patch antenna B can likewise be constructed with a frame-shaped radiator surface 211 with interior recess and corresponding supply, the supply possibly also comprising two interacting phase shifter lines 247' and 247". The flat patch antenna B, which is preferably sheet-shaped in the embodiment shown, has an angular recess 401 in each corner area, which is offset inwards away from its outer circumferential limit lines and the size of which, i.e. dimensions and position, corresponds to the platform-shaped elevations 303 in the dielectric. This means it is possible to place this patch antenna B onto the dielectric 3, i.e. on its surface 3*a*, such that the angular platforms 303 upwardly overframing the surface or the upper side 3*a* of the dielectric 3 extend through the corresponding recesses 401 in the radiator surface 11 of the patch antenna B. Thus the patch antenna B is located flat on the surface 3*a* of this dielectric 3 and is retained securely and fixed by means of the corresponding recesses 401 in the patch antenna B.

The patch antenna A is then placed onto this structure, the frame-shaped radiator surface 11 of said patch antenna A then resting on the upper side 303' of the platform-shaped corner or angular pieces and overlapping the patch antenna A.

The fact that the actual dielectric in the embodiment shown still has a large number of square apertures through it is not of crucial importance.

In the case of the described variant, both patch antennae A and B can preferably consist of a metal sheet construction i.e. the patch antennae A and B are produced by stamping, the patch antenna A then additionally being deformed three-dimensionally by edging in order to construct the corresponding lateral radiator surface portions 19 described, in the same process. The feeder lines can likewise be produced in both the patch antennae A and B by stamping and edging as described. Preferably, however, it is provided in this embodiment that radial pins are used for the supply instead of the feeder lines, which are bent, i.e. produced by stamping the edges, and are described with reference to the other embodiments. This means that a cylindrical pin, which can be soldered on at the relevant feed point, is preferably used for both the outer and inner patch antennae A and B respectively.

Thus a complete construction emerges in which the outer patch antenna A is three-dimensional, similarly to in the other embodiments, the complete form having less of a cuboid shape than a pyramid shape (as a result of the lateral radiator surface portions 19, which are arranged downwards divergently from the top), the inner second patch antenna B being constructed such that it is purely flat and not three-dimensional, i.e. without the lateral radiator surface portions 19.

In the case of the described antenna, the outer, i.e. upper, patch antenna arrangement A is preferably used for receiving SDARS services, whereas the inner or lower patch antenna B, which is flat in the embodiment shown, is preferably used for GPS services. In other words, the inner second patch antenna B has a two-dimensional structure, i.e. two-dimensional surface, whereas the outer patch antenna is three-dimensional.

The invention claimed is:

1. Patch antenna comprising:

a dielectric substrate with an upper surface, an underside at a distance from the upper surface and circumferential lateral surfaces or lateral walls between the upper surface and the underside, a ground plane provided on the underside or below the underside of the substrate;

an electrically conductive radiator surface arranged on the upper surface or above the upper surface of the substrate, a supply structure to supply the radiator surface, the radiator surface comprising an annular and/or frame-shaped radiator surface, which extends around a recess area, on the lateral surfaces or lateral walls or at a distance to the lateral surfaces or lateral walls, a lateral surface radiator structure galvanically connected to the radiator surface comprising, in the peripheral direction of the lateral surfaces or lateral walls, lateral radiator surface portions, between which electrically non-conductive recess areas are provided, the lateral radiator surface portions comprising a number of lateral radiator surface structures and/or recess areas, which are at least substantially triangular, trapezoidal or wave-shaped or are structured in accordance with a fractal pattern, from the radiator surface towards the ground plane;

the supply structure being disposed on the plane of the radiator surface in the region of the recess in the radiator surface, the supply structure comprising a phase shifter arrangement connected to the radiator surface at two connection points causing a phase shift, and the phase shifter arrangement being arranged on the plane of the radiator surface in the region of the recess in the radiator surface, the phase shifter arrangement being galvanically connected to the radiator surface.

2. Patch antenna according to claim 1, wherein the supply structure is connected to the radiator surface at an inner border thereof, the connection points being arranged offset by 90° in relation to the central axis passing through the patch antenna centrally or perpendicular to the radiator surface.

3. Patch antenna according to claim 1 wherein the lateral radiator surface portions extend to a lower partial height than the total height of the substrate, which end at a distance from the underside of the substrate and/or the electrically non-conductive recess areas extend to a height (H) of the substrate or to a partial height of it, and end at a distance below the underside of the substrate and/or below the radiator surface.

4. Patch antenna according to claim 1, wherein an overlapping region emerges on the lateral surfaces or lateral walls in which circumferential lateral radiator surface portions alternate with recess areas.

5. Patch antenna according to claim 1, wherein a limiting and/or contour line, which is larger than the circumferential length of the substrate, is formed on the lateral surfaces or wall surfaces by the interconnecting lateral radiator surface sections and the electrically non-conductive recess areas and extend in between these areas.

6. Patch antenna according to claim 1, wherein the feed point for the feeder line is arranged in the phase shifter line such that a 90° phase shift is created at the connection points of the annular or frame-shaped radiator surface.

7. Patch antenna according to claim 1, wherein the phase shifter line extends in the form of a partial circle, at right angles, with multiple angles or arc-shaped in plan view, two coupling lines being formed, starting from the feed point to the connection points on the radiator surface via which a run time and phase shift of 90° is generated in relation to the feed point on the radiator surface.

8. Patch antenna according to claim 1, further comprising plural phase shifter lines rotationally offset by 180° and/or are connected to another pair of connection points turned rotationally by 180°, the plural phase shifter lines comprising feed points provided in the phase shifter lines, the feed points being supplied with a 180° phase shift.

9. Patch antenna according to claim 7, further comprising a capacitive coupling between the phase shifter line and the coupling lines, which extend parallel to the coupling lines of the phase shifter, in the recess.

10. Patch antenna according to claim 1, wherein the substrate comprising a square form in plan view with a square annular and/or frame-shaped radiator surface or a cylindrical form with an annular radiator surface constructed on top of it or an outer contour formed in the manner of a regular polygon with a radiator surface formed correspondingly.

11. Patch antenna according to claim 1, wherein the lateral surfaces or lateral walls extend perpendicular to the radiator surface and/or perpendicular to the upper surface and/or underside of the substrate and/or parallel to the central axis of the patch antenna.

12. Patch antenna according to claim 1, wherein the lateral surfaces or lateral walls extend at an angle to the radiator surface and/or perpendicular to the upper surface and/or underside of the substrate and/or parallel to the central axis of the patch antenna, the angle ($\alpha$), which is formed between the underside of the substrate and therefore a plane extending perpendicular to the central axis and a sectional plane extending perpendicular to it taking up the central axis, is larger than 10°, and that this angle ($\alpha$) is smaller than 170°.

13. Patch antenna according to claim 1, wherein the patch antenna is constructed as a circular polarised patch antenna.

14. Patch antenna according to claim 1, wherein the lateral radiator surface portions are provided or constructed directly on the surface of the lateral walls or lateral surfaces of the substrate, in the form of a metallised surface, together with a metallised surface constructed on the surface of the substrate, the radiator surface being thus formed.

15. Patch antenna according to claim 1, wherein the lateral radiator surface portions are arranged in a lateral clearance from the lateral walls or lateral surfaces of the substrate and perpendicular or at an angle to the radiator surface.

16. Patch antenna according to claim 1, wherein the lateral surface radiators and the whole radiator structure with the radiator surface and the lateral surface radiator structure and the phase shifter line and with the feeder line consists of an electrically conductive metal sheet, on which the lateral radiator surface portions and/or the feeder line are angled in relation to the radiator surface) and the phase shifter line through bending or edging.

17. Patch antenna according to claim 16, wherein the lateral radiator surface portions have multiple angles.

18. Patch antenna according to claim 1, wherein a hollow space is formed in the substrate, which is accessible from at least one side, the substrate being box-shaped.

19. Patch antenna according to claim 18, wherein at least one additional electrical assembly or component is accommodated in the hollow space in the substrate with a circuit board positioned there.

20. Patch antenna according to claim 1, further comprising a ground plane provided on the underside or below the underside of the substrate, and a first patch radiator is formed by the radiator surface, the lateral surface radiator structure and the supply structure, and a second patch antenna with a second radiator surface is provided below the radiator surface of the first patch radiator and above the ground plane.

21. Patch antenna according to claim 20, wherein the radiator surface of the second patch antenna comprising an annular and/or frame-shaped radiator surface, which extends around a recess area.

22. Patch antenna according to claim 21, wherein a supply structure for the second patch antenna is provided inside the recess of the second patch radiator and comprises a phase shifter arrangement, which is connected at two connection points to the radiator surface causing a phase shift, the supply structure being galvanically or capacitively connected to the radiator surface in the form of a phase shifter arrangement.

23. Patch antenna according to claim 22, wherein the supply structure of the second patch antenna with the phase shifter arrangement comprises two phase shifter lines at the connection points of which an associated feeder line ends.

24. Patch antenna according to claim 21, wherein the radiator surface of the second patch antenna is arranged on a dielectric in the form of a solid body, which consists of ceramic, and that the second patch antenna is surrounded by the dielectric of a support device, which consists of plastic, by which the radiator surface of the first patch antenna is retained.

25. Patch antenna according to claim 21, further comprising a ground plane provided on the underside or below the underside of the substrate, and the radiator surface of the second patch antenna comprises a lateral surface radiator structure transverse to it, which is overlapped at least to a partial height by the lateral surface radiator structure of the first patch antenna, the lateral radiator surface portions of the first patch antenna ending between the radiator surface of the second patch antenna and the ground plane.

26. Patch antenna according to claim 21, wherein the first and the second patch antenna are mounted on a support structure consisting of a dielectric and/or support device, which comprises an inner circumferential groove or an inner circumferential receiving space in which the lateral radiator surface portions of the second patch antenna and/or an outer circumferential groove-shaped receiving space on the support structure or the support device, in which the lateral radiator surface portions of the first patch antenna end and are locked in place with the support structure or the support device.

27. Patch antenna according to claim 1, wherein the radiator surface is constructed as a continuous surface.

28. Patch antenna according to claim 20, wherein the second patch antenna is flat in construction.

29. Patch antenna according to claim 28, wherein the second patch antenna has recesses and the dielectric has platform-shaped elevations protruding upwards beyond the upper surface of the dielectric, which extend through the recesses in the flat second patch antenna so that the second patch antenna rests on the surface of the dielectric and that the first patch antenna rests with its radiator surface on the upper surface of the platform-shaped elevations.

30. Patch antenna according to claim 1, wherein the lateral radiator surface portions of the patch antenna are arranged diverging from their radiator surface towards the ground plane, a truncated pyramid-shaped structure emerging as a result.

31. Patch antenna according to claim 1 wherein the lateral radiator surface portions are triangular-shaped.

32. Patch antenna according to claim 1 wherein the lateral radiator surface portions are trapezoidal-shaped.

33. Patch antenna according to claim 1 wherein the lateral radiator surface portions comprise a number of lateral radiator surface structures and/or recess areas are arranged to define a limitation or contour line extending in periodic wave.

34. Patch antenna according to claim 1 wherein the lateral radiator surface portions comprising a number of lateral radiator surface structures and/or recess areas are arranged in a fractal pattern so that a limitation/contour line following this fractal pattern is created between the structures and the recess areas.

35. Patch antenna according to claim 1 wherein the lateral radiator surface portions comprising a number of lateral radiator surface structures and/or recess areas are arranged in a meandering shape such that a meandering shaped limitation and/or contour line emerges by which the lateral radiator surface structures are separated from the recess areas which are offset in the circumferential direction.

* * * * *